US007163589B2

(12) United States Patent
Kaiser

(10) Patent No.: US 7,163,589 B2
(45) Date of Patent: Jan. 16, 2007

(54) METHOD AND APPARATUS FOR DECONTAMINATION OF SENSITIVE EQUIPMENT

(75) Inventor: Robert Kaiser, Winchester, MA (US)

(73) Assignee: Argos Associates, Inc., Winchester, MA (US)

( * ) Notice: Subject to any disclaimer, the term of this patent is extended or adjusted under 35 U.S.C. 154(b) by 603 days.

(21) Appl. No.: 10/154,488

(22) Filed: May 23, 2002

(65) Prior Publication Data

US 2003/0102007 A1 Jun. 5, 2003

Related U.S. Application Data

(60) Provisional application No. 60/292,967, filed on May 23, 2001.

(51) Int. Cl.
*B08B 7/04* (2006.01)
*B08B 3/12* (2006.01)

(52) U.S. Cl. ..... 134/18; 134/10; 134/1; 134/34

(58) Field of Classification Search ..... 134/1, 134/10, 18, 34; 588/299, 401, 304
See application file for complete search history.

(56) References Cited

U.S. PATENT DOCUMENTS

| | | | | |
|---|---|---|---|---|
| 3,929,662 | A | 12/1975 | Boucher | |
| 4,850,380 | A * | 7/1989 | Koslow | 134/56 R |
| 5,069,797 | A * | 12/1991 | Bartram et al. | 210/690 |
| 5,143,621 | A * | 9/1992 | Bartram et al. | 210/690 |
| 5,273,592 | A * | 12/1993 | Chi Li | 134/40 |
| 5,316,690 | A * | 5/1994 | Li | 510/412 |
| 5,612,300 | A * | 3/1997 | von Blucher et al. | 510/110 |
| 6,300,638 | B1 * | 10/2001 | Groger et al. | 250/458.1 |
| 6,448,062 | B1 * | 9/2002 | Huth et al. | 435/264 |
| 6,558,432 | B1 * | 5/2003 | Schulte et al. | 8/142 |
| 6,727,400 | B1 * | 4/2004 | Messier et al. | 588/315 |

FOREIGN PATENT DOCUMENTS

DE 3312577 A1 * 11/1984

* cited by examiner

*Primary Examiner*—Alexander Markoff
(74) *Attorney, Agent, or Firm*—Cesari and McKenna, LLP

(57) ABSTRACT

Ultrasonic solvent cleaning processes can effectively decontaminate sensitive equipment. The disclosed decontamination liquids meet the following criteria:

a. It is compatible with a wide range of sensitive equipment—the performance of electronic and optical equipment is not affected by immersion in decontamination liquid.
b. The principal chemical warfare agents of concern are sufficiently soluble in decontamination liquid for it to be an effective decontamination medium.
c. The principal chemical warfare agents of concern are quantitatively removed from solution in decontamination liquid by activated carbon. When agent contaminated decontamination liquid is passed through a bed of activated carbon, the agent adsorbs onto the activated carbon, resulting in agent free decontamination liquid that can be recycled and reused.
d. It is nonflammable, nontoxic, and environmentally acceptable.

Ultrasonic agitation provides effective mass and physical transfer of contaminants from the surfaces of the objects being decontaminated to the bulk of the decontamination liquid.

Contaminant removal occurs in three steps: removal of the contaminant from the surface of the part being processed, transfer of the dissolved or suspended contaminant into the bulk of the decontamination liquid in the immersion sump, and then removal of the dissolved contaminant by activated carbon adsorption, or suspended contaminant by filtration.

Biological contaminants are also effectively removed or inactivated by immersion and sonication in decontamination fluid or solutions of a soluble surfactant in decontamination fluid.

Activated carbon beds and filters that come into contact with contaminated liquid can be contained in commercially available housings that shield the system operator from any contained toxic contents. These sealable containers, and their contents, can be destroyed by standard methods, such as incineration.

Spectrographic fluorimetry can detect extremely low levels (of the order of 10 ppt) of fluorescent dyes dissolved in decontamination fluid.

Decontamination of sensitive equipment in decontamination fluid can be performed in commercially available ultrasonic vapor degreasers.

2 Claims, 18 Drawing Sheets

| EXPERI-MENT NO. | SENSITIVE EQUIPMENT PROCESSED | INITIAL WEIGHT, GRAMS | CONTAMI-NATED WEIGHT, GRAMS | CONTAMI-NANT WEIGHT, GRAMS | WEIGHT AFTER REMOVAL FROM POLY-KLEEN SYSTEM, GRAMS | FINAL POST-CLEANING EQUILIBRIUM WEIGHT, GRAMS | WEIGHT CHANGE FINAL-INITIAL, GRAMS | WEIGHT CHANGE/ CONTAMINANT WEIGHT | VISUAL OBSERVATIONS |
|---|---|---|---|---|---|---|---|---|---|
| 1 | MULTIMETER | 94.44 | 94.74 | 0.30 | 94.64 | 94.64 | 0.20 | 66.7% | VISIBLE SURFACE ATTACK BY DEP |
| | | | | | | | | | |
| 2 | MICROSCOPE SLIDE 1 | 7.3412 | 7.7348 | 0.3936 | 7.3409 | 7.3409 | 0.00 | -0.1% | CLEAN |
| | MICROSCOPE SLIDE 2 | 7.5445 | 7.8208 | 0.2763 | 7.5542 | 7.5542 | 0.01 | 3.5% | CLEAN |
| | CIRCUIT BOARD 1 | 11.9038 | 12.3372 | 0.4334 | 11.8991 | 11.8991 | 0.00 | -1.1% | CLEAN |
| | CIRCUIT BOARD 2 | 11.8483 | 12.1730 | 0.3247 | 11.8472 | 11.8472 | 0.00 | -0.3% | CLEAN |
| | | | | | | | | | |
| 3 | MULTIMETER 1 (FACE DOWN) | 94.8175 | 96.2810 | 1.4635 | 95.0474 | 94.8499 | 0.03 | 2.2% | TRACE OF WHITE RESIDUE ON DIAL |
| | MULTIMETER 2 (FACE UP) | 94.5852 | 95.5223 | 0.9371 | 94.7732 | 94.573 | -0.01 | -1.3% | YELLOW RESIDUE ON DIAL |
| | | | | | | | | | |
| 4 | MULTIMETER | 94.44 | 96.27 | 1.83 | 94.46 | 94.46 | 0.02 | 1.1% | |
| | | | | | | | | | |
| 5 | MULTIMETER | 94.43 | 96.45 | 2.02 | 94.58 | 94.43 | 0.00 | 0.00 | SiO2 RESIDUE OBSERVED |
| | | | | | | | 0.00 | | |
| 6 | GPS RECEIVER | 346.03 | 347.24 | 1.21 | 346.07 | 346.07 | 0.04 | 3.3% | CLEAN |
| | RADIO SHACK CALCULATOR | 92.18 | 93.87 | 1.69 | 92.01 | 92.01 | -0.17 | -10.1% | CLEAN |
| | | | | | | | | | |
| 7 | MULTIMETER | 94.87 | 97.42 | 2.55 | 94.97 | 94.97 | 0.10 | 3.9% | CLEAN |
| | NIGHT VISION GOGGLES | 1281.48 | 1284.39 | 2.91 | 1304.36 | 1281.11 | -0.37 | -12.7% | CLEAN |
| | | | | | | | | | |
| 8 | MULTIMETER | 94.66 | 95.41 | 0.75 | 94.87 | 94.72 | 0.06 | 8.0% | CLEAN |
| | CIRCUIT BOARD | 5.20 | 5.21 | 0.01 | 5.20 | 5.20 | 0.00 | 0.0% | CLEAN |
| | | | | | | | | | |
| 9 | WALTHER PP PISTOL | 672.22 | 673.39 | 1.17 | 672.13 | 672.13 | -0.09 | -7.7% | CLEAN |
| | | | | | | | | | |
| 10-A | MULTIMETER | 94.79 | 97.69 | 2.9 | 95.44 | 94.82 | 0.03 | 1.0% | CLEAN |
| 10-B | MULTIMETER | 94.82 | 97.72 | 2.9 | 94.91 | 94.88 | 0.06 | 2.1% | CLEAN |
| 10-C | MULTIMETER | 94.88 | 97.35 | 2.47 | 94.86 | 94.88 | 0.00 | 0.0% | CLEAN |
| 10-D | MULTIMETER | 94.88 | 97.42 | 2.54 | 94.83 | 94.83 | -0.05 | -2.0% | CLEAN |
| | PIPE NIPPLE | 162.66 | 164.19 | 1.53 | 162.65 | 162.65 | -0.01 | -0.7% | CLEAN |
| | | | | | | | | | |
| 10-E | MULTIMETER | 94.83 | 98.05 | 3.22 | 98.40 | 94.81 | -0.02 | -0.6% | CLEAN |
| | | | | | | | | | |
| 11 | PIPE 1 (HORIZONTAL) | 205.69 | 207.06 | 1.37 | 205.68 | 205.68 | -0.01 | -0.07% | CLEAN |
| | PIPE 2 (VERTICAL) | 204.83 | 206.07 | 1.24 | 204.83 | 204.83 | 0.00 | 0.0% | CLEAN |
| | MAGNET ASSEMBLY 1 (HOR.) | 8.07 | 8.15 | 0.08 | 8.04 | 8.04 | -0.03 | -37.5% | CLEAN |
| | MAGNET ASSEMBLY 2 (VER.) | 8.09 | 8.19 | 0.10 | 8.09 | 8.09 | 0.00 | 0.0% | CLEAN |
| | | | | | | | | | |
| 12 | MULTIMETER | 94.20 | 96.83 | 2.63 | 94.42 | 94.19 | -0.01 | -0.4% | CLEAN |
| | | | | | | | | | |
| 13 | MULTIMETER | 94.62 | 94.69 | 0.07 | 94.76 | 94.65 | 0.03 | 42.9% | CLEAN |
| 14 | MULTIMETER | 94.55 | 94.63 | 0.08 | 97.09 | 94.58 | 0.03 | 37.5% | CLEAN |
| 15 | MULTIMETER | 94.19 | 94.26 | 0.07 | 94.35 | 94.22 | 0.03 | 42.9% | CLEAN |
| 16 | MULTIMETER | 94.82 | 94.89 | 0.07 | 97.45 | 94.83 | 0.01 | 14.3% | CLEAN |
| 17 | MULTIMETER | 94.71 | 94.78 | 0.07 | | 94.75 | 0.04 | 57.1% | CLEAN |

FIG. 12 SENSITIVE EQUIPMENT CLEANING RESULTS

METHOD AND APPARATUS FOR DECONTAMINATION OF SENSITIVE EQUIPMENT

CROSS-REFERENCE TO RELATED APPLICATIONS

The present application claims the benefit of U.S. Provisional Patent Application Ser. No. 60/292,967, which was filed on May 23, 2001, by Robert Kaiser for a Method and Apparatus for Decontamination of Sensitive Equipment which is hereby incorporated by reference.

This invention was made with government support under contract F41624-98-M-5061, awarded by the Department of the Air Force. The Government has certain rights in the invention.

BACKGROUND OF THE INVENTION

1. Field of the Invention

This invention relates to cleaning equipment, and more particularly, to cleaning sensitive equipment contaminated with biological or chemical contaminants.

2. Background Information

While much of the military equipment that is susceptible to chemical or biological threat agents can be decontaminated with aqueous decontamination agents, there are broad classes of critical equipment, including optical, electronic, and communications devices, that are rendered nonfunctional by such treatment. Historically, such equipment had been decontaminated by spraying and flushing with CFC-113, which is no longer commercially available.

Alternate methods and equipment of nondestructively decontaminating water sensitive military equipment, such as electronic systems components aboard military aircraft, are needed. Such methods should be effective against a wide variety of threats, be non-toxic to personnel, not degrade the equipment being decontaminated, and be field deployable. Decontamination system equipment should be highly mobile and self-sustaining. These methods should also be able to treat equipment that is besmirched with battle field soils, including dirt (particulates), dried mud, oils, etc. In a broader context, the methods and equipment should also be capable of performing maintenance cleaning operations in a depot environment (i.e. dual use capability). These methods and equipment thus should comply with environmental regulations, and be safe to use.

An effective decontamination method removes or deactivates the contaminant without affecting the part being cleaned. When the equipment to be decontaminated is both geometrically complex in shape and thermally sensitive, additional difficulties arise. Thus, heating an article may not be a cleaning option for thermally sensitive items, which leads to problems to effectively remove relatively non-volatile contaminants.

Other methods are also limited. For example, suspended particle decontamination methods, such as carbon dioxide snow, are limited to surfaces that are in a direct line of sight with the ejection nozzle. Such methods are not effective in terms of cleaning blind holes, crevices, and obstructed surfaces. These types of methods can be abrasive and destructive to the equipment being decontaminated. Capture and processing of contaminant laden particles may be a problem, as well.

In the past, commercially available organic (i.e. nonaqueous) liquids which would be both effective cleaning/decontamination media, and which would satisfy current and projected future safety and environmental criteria could not be used. This is because those volatile organic liquids that exhibited good solvency for chemical threat agents were flammable, toxic, or environmentally unacceptable.

SUMMARY OF THE INVENTION

A method and apparatus to clean sensitive equipment from both biological and chemical contaminants (such as chemical warfare agents) is provided. The method utilizes cleaning solvents or decontamination liquids such as Hydrofluorocarbons (HFCs), including hydrofluoroethers (HFEs), which have physical properties that are similar to those of CFC-113. The principal commercially available products are Du Pont's Vertrel-XF (HFC 43-10mee, 2-3 dihydrodecafluoropentane) and 3M's Novec HFE-7100 (methyl nonafluorobutyl ether). In addition to fluorine, these materials contain carbon, hydrogen, and oxygen (for HFEs), but no chlorine; and therefore have no known ozone depletion potential. The presence of a minority of hydrogen atoms results in a molecule that has many of the characteristics of a perfluoroalkane molecule, but also some characteristics of a hydrocarbon molecule.

While the HFC's have many of the properties and useful characteristics of CFC-113, such as wide materials compatibility, low toxicity, and lack of flammability, they advantageously do not possess the environmental limitations of CFC-113. They are not classified as volatile organic compounds (VOCs), hazardous air pollutants (HAPs), or ozone depleting chemicals (ODCs).

HFCs exhibit significant solvency for oxygenated compounds such as esters, ketones, ethers, and ether alcohols and lower molecular weight aliphatic hydrocarbons. Since the physical chemical characteristics of the chemical warfare agents (CWA) of principal concern (mustard (HD) and the nerve agents (GA, GB, GD, and VX)) are similar to those of esters (esters are often used as harmless agent simulants). The solubility of these CWA in HFCs and HFEs is sufficiently high to allow contaminated parts to be decontaminated by immersion in these solvents. The performance characteristics of the HFCs/HFEs can also be improved by the addition of functional additives or co-solvents that do not degrade the inherent safety and environmental characteristics of these materials, as needed.

In the case of decontamination of CWA's from sensitive equipment, the HFCs are used in conjunction with filters and/or activated carbon which removes the contaminants from the HFCs and allow the clean HFC to be reused or recycled.

In the case of decontamination of biological agents from the equipment, HFCs may be used in conjunction with surfactant which with the HFC aids in removing or deactivating the biological contaminant. A series of filters may then be used to remove the contaminants.

An apparatus according to one embodiment may include an immersion sump for ultrasonically contacting the contaminated equipment with decontamination liquid or cleaning solvents (HFCs and surfactant), a boil sump for heating the cleaning solvents, a drying sump for drying the cleaned equipment, and filters or activated carbon beds, for removing the contaminants, as discussed above, and purifying the cleaning or decontamination liquid.

BRIEF DESCRIPTION OF THE DRAWINGS

The detailed description of an illustrative embodiment of the invention below refers to the accompanying drawings, of which:

FIG. 12 is a table showing the results of some tests of one embodiment of the system.

DETAILED DESCRIPTION OF AN ILLUSTRATIVE EMBODIMENT

Figure 1:
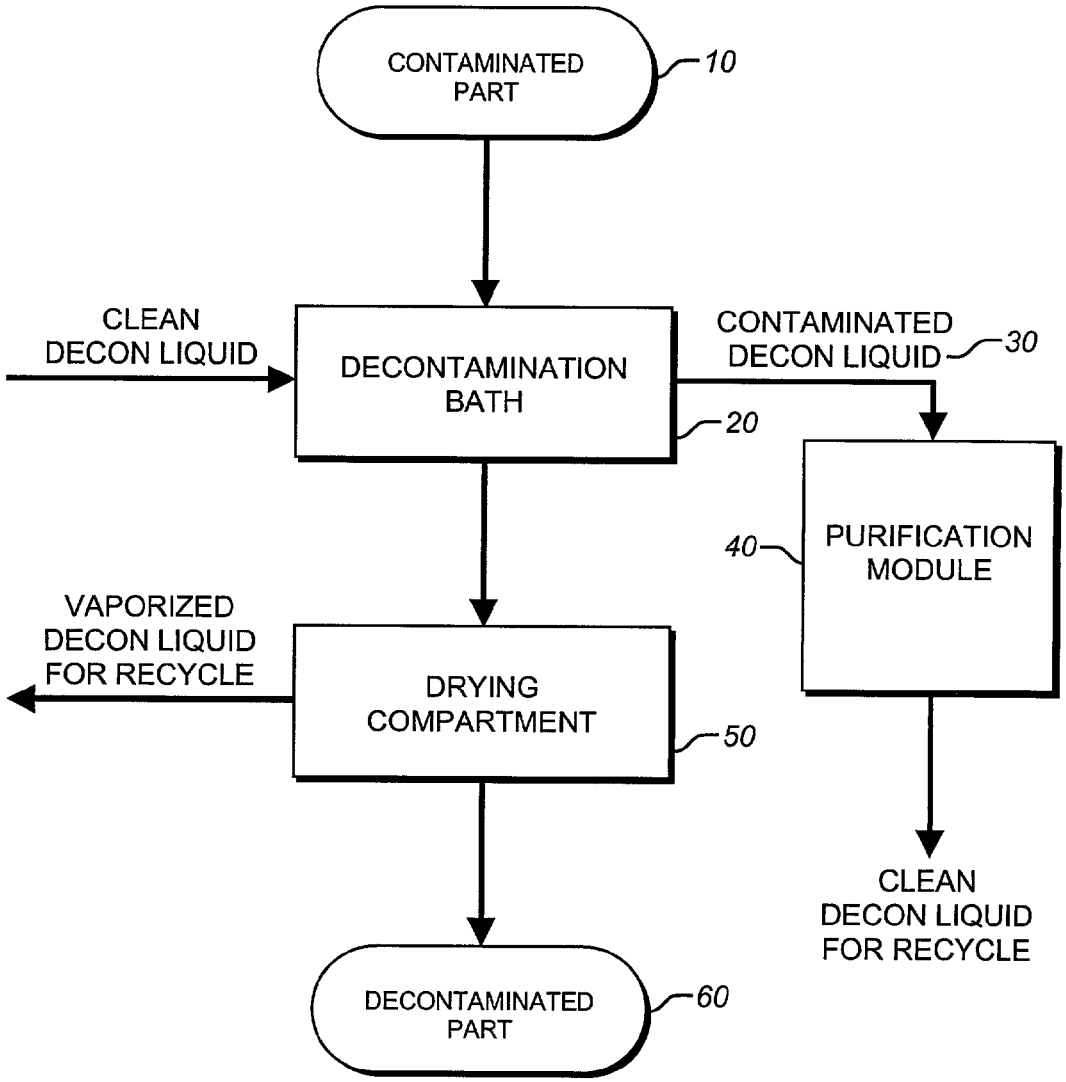
FIG. 1 is a general process flow chart of a process for decontaminating an article.

The contaminated parts are sprayed with a fluorescent marker and immersed in a bath filled with decontamination liquid. In this bath, surface contaminants are removed from the surface of the parts and transferred to the decontamination liquid, either by solution or by suspension. Contaminated decontamination liquid is withdrawn from the bath and sent to a purification module that removes the dissolved or suspended contaminants from the liquid. The purified liquid is returned to the bath through spray nozzles to further treat the contaminated parts and decontaminate the cleaning chamber.

The parts remain in the bath until a prescribed cleaning regime is completed or until fluorescence sensors in the fluid circuits can no longer detect the fluorescent marker in the solvent that exits the cleaning chamber. The operator who opens the clean side door can verify that there are no longer any harmful levels of contaminants remaining on the treated parts by visually examining the parts for residual fluorescent marker before the parts are removed from the cleaning chamber.

For effective decontamination to occur, sufficient shear is provided to result in effective mass and physical transfer of contaminants from the surfaces of the objects being decontaminated to the bulk of the decontamination liquid.

1) Ultrasonic agitation is a preferred means of providing this shear action.
2) For ultrasonic agitation to be effective, a power density of at least about 60 watts/gallon (15 watts/liter) is preferred.
3) The ability to generate ultrasonic power over a range of frequencies, from about 40 kHz to about 170 kHz, is essential preferred because it rapidly removes a range of particle sizes from the surface of the immersed part.
4) Oils soluble in decontamination fluid, but thickened with a non-soluble additive, are removed from exposed surfaces by high intensity ultrasonic agitation.

Biological contaminants are also effectively removed or inactivated by immersion and sonication in decontamination fluid or solutions of a surfactant soluble in the decontamination fluid, such as, Krytox 157FS in decontamination fluid. More specifically:

1) Vegetative cells are killed by sonication in decontamination fluid.
2) Processing in decontamination fluid with up to 4% to 6%, Krytox 157FS can result in the sterilization of slides initially contaminated with approximately 100 spores (i.e. $>10^5$ spores/$m^2$).
3) Processing in these solutions also sterilizes slides that had been initially contaminated with $10^4$ bacteriophage particles.
4) Immersion in decontamination fluid, with or without surfactant, denatures proteins.
5) The physical removal of biological species from a contaminated surface by sonication in decontamination fluid is enhanced by the presence of >1% Krytox 157FS in the decontamination fluid, and by the use of higher frequency ultrasonic (>100 kHz) agitation.

It should be noted that the mechanism for the removal of radioactive contaminants is similar to the removal of spores.

A generalized process flow chart for one system for decontamination of sensitive equipment is outlined in FIG. 1. The contaminated equipment or part 10 is immersed in a bath 20 filled with decontamination liquid. In this bath 20, surface contaminants are removed from the surface of the parts and transferred to the decontamination liquid, either by dissolution or by suspension. Contaminated decontamination liquid is withdrawn from the bath, either continuously, or by dumping the entire contents of the bath, and sent to a purification module 40 that removes the dissolved or suspended contaminants from the liquid. The purified liquid is returned to the bath 20 to further treat the contaminated parts.

The parts remain in the bath 20 until the operator is assured that there are no longer any harmful levels of contaminants remaining on the treated parts. The parts may be then transferred to a drying chamber 50 where residual decontamination liquid is vaporized and recycled by condensation. The dry, decontaminated part 60 is finally removed from the process.

The decontamination liquid, preferably, is able to suspend or dissolve agent(s) and allows the contaminants to be subsequently removed from solution or suspension. This allows the liquid to be recycled and minimizes its on-board inventory. The present method and apparatus can be used to decontaminate CWAs and/or biological contaminants from the equipment.

b. The principal chemical warfare agents (CWA) of concern are sufficiently soluble in the decontamination liquid for it to be an effective decontamination medium.
c. The principal chemical warfare agents (CWAs) of concern can be effectively removed from the decontamination liquid. Preferably, when agent contaminated decontamination liquid is passed through a purification module, the agent is quantitatively removed from the decontamination liquid, resulting in contaminant free decontamination liquid that can be recycled and reused.
d. It is nonflammable, nontoxic, and environmentally acceptable.

Table 1 below lists the properties of decontamination liquids compared to the properties of Freon TF. These materials have been shown to be effective decontamination fluids.

TABLE 1

Properties of Decontamination Solvents

| Solvent | Vertrel-XF [HFC-43-10] | HFE-7100 | HFE-7200 | Vertrel KCD 9572 | Vertrel XP-10 | N-CHP |
|---|---|---|---|---|---|---|
| Chemical Formula | C5F10H2 | C5F9H3O | C6F9H5O | Note 1 | Note 2 | Note 3 |
| Supplier | Du Pont | 3M Co. | 3M Co. | Du Pont | Du Pont | BASF |
| Molecular Weight | 252 | 250 | 264 | NA | NA | 167 |
| Boiling Point, ° C. | 54 | 61 | 76 | 38 | 54 | 292 |
| Freezing Point, ° C. | −80 | −135 | −138 | <−50 | <−80 | 15 |
| Heat of Vaporization, cal/g @ bp | 31 | 30 | 30 | 51 | | 95 |
| Specific Heat, cal/g @ 25° C. | 0.27 | 0.28 | 0.29 | 0.28 | | 0.3 |
| Specific Gravity (H20 = 1) | 1.58 | 1.52 | 1.43 | 1.24 | 1.42 | 1.03 |
| Viscosity, cp @ 25° C. | 0.67 | 0.61 | 0.61 | 0.49 | | 8 |
| Surface Tension, dynes/cm @ 25° C. | 14.1 | 13.6 | 13.6 | 16.1 | | 42 |
| Vapor Pressure, mm Hg @ 25° C. | 226 | 202 | 109 | 461 | 226 | 0.007 |
| Solubility of | | | | | | |
| Water in Solvent, ppm | 490 | 95 | 92 | 490(c) | (d) | miscible |
| Solvent in Water, ppm | 140 | <12 | 20 | 140(c) | (d) | miscible |
| Hildebrand Solubility Parameter, MPa^0.5 | 13.8 | 12.4 | 12.9 | 16.0 | 15.0 | 20.3 |
| VOC, lbs/lb | 0 | 0 | 0 | 0.5(a) | 0.1(b) | 0.4(e) |
| Ozone Depletion Potential (CFC-11 = 1.0) | 0 | 0 | 0 | 0 | 0 | na |
| Global Warming Potential (100 yr ITH) | 1700 | 320 | 55 | 1700(c) | 1700(c) | na |
| Atmospheric Lifetime, yrs | 17.1 | 4.1 | 0.8 | 17.1(c) | 17.1(c) | na |
| Flashpoint, ° C. | None | None | None | None | None | 140 |
| Flammability Range in Air, % | None | None | 2.4–12.4% | 6–11 | 5–11 | 0.9–7.3 |
| Exposure Guidelines, 8 hr TWA, ppm | 200 | 750 | 200 | 200 | 200 | 100 |

Note 1: Vertrel 9572 is now available as Vertrel MCA+ Composition: Vertrel-XF - 50 wt %, 1,2 trans-dichloroethylene - 45 wt %, Cyclopentane - 5 wt %
Note 2: Vertrel XP-10 Composition: Vertrel XF - 90 wt %, Isopropanol (IPA) - 10 wt %.
(a)Based on trans1–2 dichloroethylene and cyclopentane content
(b)Based on IPA content
(c)Based on Vertrel-XF content
(d)IPA fraction is water miscible
(e)As per EPA Test method EMTIC M-24A The decontamination liquid for CWA decontamination preferably meets the following criteria:

a. It is compatible with a wide range of sensitive equipment—i.e. the performance of electronic and optical equipment is not affected by immersion in the liquid.

3M's HFE 7500, a hydrofluoroether with a molecular weight of 414 and a Hildebrand solubility parameter of about 11.9 has also been shown to be effective The properties of four major CWAs are shown in Table 2 below:

TABLE 2

Physical-Chemical Properties of Chemical Warfare Agents Examined

| Agent | HD | GB | GD | VX |
|---|---|---|---|---|
| Chemical Formula | C4H8C12S | C4H10FO2P | C7H16FO2P | C11H26NO2PS |
| Molecular Weight | 159 | 140 | 182 | 267 |
| Specific Gravity @ 25° C. | 1.27 | 1.092 | 1.025 | 1.011 |
| Viscosity , cs | 4.07 | 1.28 | 3.10 | 9.96 |
| @ Temperature, ° C. | 20 | 25 | 25 | 25 |
| Surface Tension @ 20° C., dynes/cm | 43.2 | 26.5 | 24.5 | 32 |
| Freezing Point, ° C. | 14.5 | −56 | −42 | −50 |
| Boiling Point, ° C. | 217.5 | 158 | 198 | 298 |
| Vapor Pressure @ | | | | |
| 20° C. | 0.069 | | | |
| 25° C. | 0.11 | 2.9 | 0.4 | 0.00063 |
| 60° C. | 1.7 | 18 | 3.2 | 0.015 |
| Hildebrand Solubility Parameter, MPa^½ | 21.4 | 17.6 | 16.9 | 18.2 |
| Solubility in Water @ RT, gr/100 gr | 0.92 | Miscible | 2.1 | 3.0 |
| LD 50 (skin), mg/kg | 100 | 24.3 | 5 | 0.14 |
| LD 50 (oral), mg/kg | 0.7 | | | |
| Toxicity Limit, 8-hr TWA, mg/m3 | 0.003 | 0.0001 | 0.00003 | 0.00001 |
| Flash Point, ° C. | 105 | >280 | 121 | 159 |

The Hildebrand Solubility Parameter is often used as a predictor of mixing ability (solubility, compatibility) of two or more components, criteria b, above. For liquids at room temperature, this parameter ranges from a value of about 12 $Mpa^{1/2}$ for perfluoroalkanes to 47.9 $Mpa^{1/2}$ for water. The value of this parameter increases with the polarity and hydrogen-bonding capability of the material. The Hildebrand solubility parameter is a numerical expression of the chemical rule-of-thumb that similar compounds are mutually soluble (i.e. "like likes like"). Two materials that have similar solubility parameters (i.e. differ by less than 50%) tend to be mutually soluble, whereas materials that have significantly different solubility parameters usually are immiscible (such as water and perfluoroheptane). The estimated values of the Hildebrand solubility parameter for the CWA listed in Table 2 range from 16.9 $Mpa^{1/2}$ for GD to 21.4 $Mpa^{1/2}$ for HD. These agents are soluble in organic solvents and, except for GB, relatively insoluble in water.

The decontamination liquid, therefore, preferably has a Hildebrand Solubility Parameter that differs by less than 50% of the CWA of interest. It is also preferred that the decontamination liquids not have an identical Hildebrand solubility parameter so that the CWA can be later removed from the decontamination liquid.

Nerve agents tested were miscible in all the solvent systems tested, miscibility being defined as complete mutual solubility of equal volumes of agent and solvent. Mustard (agent HD). It was fully miscible in CHP, and partially soluble in all the other solvents examined, including Vertrel KCD 9572.

The composition of the solvent had a significant effect on the removal of dissolved agent by adsorption on activated carbon. Specific agent loading on is presented in Table 4. In general, the higher the solubility of the agent in the solvent, the more difficult it became to remove the agent from solution by activated carbon. While differences were noted between agents, the ability of activated carbon to pull agent out of solution was higher for a "poor" solvent than for a good solvent. The lowest levels of removal by adsorption were noted with CHP, and the highest levels were noted with the HFEs (HFE-7100 and HFE-7200).

HFCs are somewhat poorer solvents for hydrocarbon base soils than CFC-113. In particular, while HFCs exhibit significant solvency for oxygenated compounds such as esters, ketones, ethers, and ether alcohols and lower molecular weight aliphatic hydrocarbons, many heavier organic soils, such as viscous oils, as well as polar or aqueous base compounds, are not soluble in Vertrel-XF or HFE-7100.

Since the physical chemical characteristics of the chemical warfare agents (CWA) of principal concern (mustard (HD) and the nerve agents (GA, GB, GD, and VX) are similar to those of esters (esters are often used as harmless agent simulants) (see Table 1–2), the solubility of these CWA in HFCs and HFEs is sufficiently high to allow contaminated parts to be decontaminated by immersion in these solvents. If the solubility was not sufficiently high, the performance characteristics of the HFCs/HFEs could be improved by the addition of functional additives or co-solvents that would not degrade the inherent safety and environmental characteristics of these materials.

The same immersion process should also result in the removal of radioactive contaminants and the removal or deactivation of biological contaminants. Small (micron sized) particles can be effectively removed from solid surfaces by sonication solutions of a fluorinated surfactant in both perfluorocarbons and hydrofluorocarbons. Radioactive particles can be removed from sensitive equipment in perfluorocarbon solutions. Since microorganisms such as bacteria and spores are small particles, fluorinated surfactant solutions should also be able to result in the detachment of these species from substrates, and may also affect their viability. These solutions are also alien media for proteins, so that immersion of protoneinaceous matter in these liquids should also result in the denaturization of harmful proteins.

Conceptually CWA can be removed from the decontamination solvent by any one of the following methods:

1. Passing the contaminated liquid over a bed of granulated activated carbon, and adsorbing the contaminant on the activated carbon granules.
2. Contacting the contaminated liquid with an immiscible liquid that contains a chemical that reacts with the CWA and destroys it. An example would be a dilute solution of sodium or calcium hypochlorite.
3. Passing the contaminated liquid over a bed of oxidizing granules, possibly calcium hypochlorite, that would react with the dissolved CWA and destroy it. Harmful daughter products would have to be subsequently removed.

4. Filtering the contaminated solution with an ultrafiltration membrane to produce a CWA free permeate and a CWA enriched retentate.
5. Since the proposed decontamination liquids are significantly more volatile than the CWA, the contaminated liquid could be distilled to produce a purified vapor that could then be condensed and recycled, and CWA enriched distillation bottoms.

The major limitation to adsorption of CWA is the presence of solutes in the used decontamination fluid that would interfere with the adsorption of the CWA also dissolved in the solution. A lesser problem is the coadsorption of non-toxic contaminants on the activated carbon granules, which would reduce bed capacity for CWA.

One alternative, solvent extraction, has the disadvantages that provisions for the handling, mixing, and separation of two immiscible liquids may be required. Such a system would likely be more complex and larger than one containing passive adsorption columns. Logistic support for two process liquids, instead of one, would have to be provided. The presence of any surface-active contaminants in the used decontamination solution could result in the formation of emulsions, which would make post-mixing gravity separation of the two phases difficult.

A third approach, adsorption with chemical reaction, may be effective. For example, it is possible to oxidize an oxidizable solute dissolved in DECONTAMINATION FLUID by contacting the solution with calcium hypochlorite. However, the extent of reaction may be sensitive to the presence of trace quantities of water on these granules.

Other approaches may generate a solution that has a relatively high concentration of CWA. Such a solution would be inherently hazardous, with the hazard level increasing with agent concentration and vapor pressure. Since vapor pressure increases with temperature, at the same concentration level, the vapor pressure of agent over a heated solution is higher than that over a cold solution. If the chemical agent is relatively volatile, such as GB, if there is any significant agent concentration in the boil sump, it will not be possible to obtain a distillate that is agent free in a single distillation stage.

Vertrel KCD 9572 (now sold as Vertrel MCA+) a mixture of Vertrel XF, trans-1,2 dichloroethylene, and cyclopentane that is a more aggressive solvent than Vertrel-XF, and that is capable of dissolving a much wider range of soils than Vertrel-XF. The solubility parameter for this system is 16.0 $Mpa^{1/2}$, which is significantly higher than that of any of the baseline HFCs, or CFC-113. This value is close to the value of the solubility parameter for the nerve agents. The materials listed in Table 2 would be expected to dissolve readily in this material. However, at the same time, removal of dissolved agent by adsorption on activated carbon may be more difficult. The inherent disadvantages of this solvent are its high VOC content (due to the presence of trans-1,2 dichloroethylene and cyclopentane), and the likelihood that it might not be compatible with some sensitive equipment.

Vertrel XP-10 is an HFC that contains a significant amount of polar material (isopropanol) that would adsorb competitively for adsorption sites on activated carbon with dissolved CWA, and thus possibly with the removal of dissolved CWA from solution. Vertrel XP-10 is an azeotrope that contains 90 wt-% Vertrel-XF and 10 wt-% isopropanol. The azeotrope, which as a solubility parameter of 15.0, should be a better solvent for CWA than Vertrel-XF.

N-cyclohexyl pyrrolidone is a cosolvent that could be used in conjunction with an HFC to produce a liquid mixture with enhanced CWA solubility characteristics. The concept was to first treat a contaminated part with a dilute solution of cosolvent in an HFC to dissolve the contaminant, and then rinse the part with pure HFC to remove residual cosolvent. Pyrrolidones were considered to be especially promising candidate cosolvents because they exhibit very broad solubility characteristics (i.e. they are miscible with a broad range of liquids, from HFCs to water), that would be likely to dissolve a broad range of CWA. Certain pyrrolidones, such as N-cyclohexyl pyrrolidone (CHP), are relatively non-volatile, allowing pyrrolidone free rinse liquid to be easily recycled by simple distillation.

EXPERIMENTAL METHOD AND RESULTS

The results of the solubility experiments are summarized in Table 3. The results of the adsorption results are summarized in Table 4.

TABLE 3

Solubility of Chemical Agents in Solvents of Interest

| | GB | GD | HD | |
|---|---|---|---|---|
| Vertrel MCA+ | M (RT) | M (RT) | 17% (RT) | M (RT) |
| Vertrel XP-10 | M (RT) | M (RT) | 8% (40° C.) | M (RT) |
| Vertrel-XF | M (RT) | M (RT) | 8% (40° C.) | M (RT) |
| HFE-7100 | M (RT) | M (RT) | 8% (40° C.) | M (RT) |
| HFE-7200 | M (RT) | M (RT) | 8% (40° C.) | M (RT) |
| CHP | M (RT) | M (RT) | M (RT) | M (RT) |

TABLE 4

Chemical Agent Removal
From Solvents of Interest by Activated Carbon

| | GB | GD | HD |
|---|---|---|---|
| Vertrel MCA+ | 0.43% | 0% | 30% |
| Vertrel XP-10 | 0% | 3.1% | 100% |
| Vertrel XF | 28% | 53% | 100% |
| HFE-7100 | 52% | 68% | 96% |
| HFE-7200 | 69% | 76% | 92% |
| CHP | 0% | 0.75% | 7.9% |

Among the CWA, agents GB and GD were more difficult to remove by adsorption than agents HD and VX were. The tendency for HD to adsorb readily is not surprising in that it was the least soluble of all the agents tested in the candidate liquids. The ability to remove agent VX by adsorption came as a favorable surprise because it dissolved so readily in all liquids tested.

Agents GB and GD were the most sensitive to solvent composition. There was essentially no adsorption of either agent from solution in Vertrel KCD 9572 or in cyclohexyl pyrrolidone. There was significantly less adsorption from solution in Vertrel-XF, with or without isopropanol, than from HFE-7100 or HFE-7200.

A second key advantage of sensitive equipment decontamination liquid is that it is compatible with the equipment being decontaminated. Contact with the decontamination liquid during a decontamination cycle can not affect the performance characteristics of the sensitive equipment being decontaminated. The decontamination process should not change either the appearance of the object or its functional (i.e. electrical, electronic, or optical) performance.

HFE-7100 and HFE-7200 were compatible with all materials that we would be likely to be used in the construction of sensitive equipment.

Other commercially available liquids that are compatible with these plastics are the perfluorocarbons (PFCs)(also produced by 3M Co.), and AK-225FPL, produced by Asahi Glass Company. AK-225 FPL is a mixture that contains 60% AK-225 (HCFC-225) and 40% HFE-7100. This mixture has somewhat better oil solubility characteristics than HFE-7100. Solubility advantages proffered by this material have to be traded off against the need for a mixture, which would be more difficult to recycle than a single component, and environmental and safety limitations.

The materials compatibility of 5% solutions of surfactant is similar to those of HFE-7100. Surfactant solutions appear to enhance the removal of biological agents from substrates.

The purification module for the decontamination of CWAs to remove contaminants from the decontamination liquid can include an activated carbon bed or other adsorbent. In addition, a series of filters may also be used.

Figure 2:
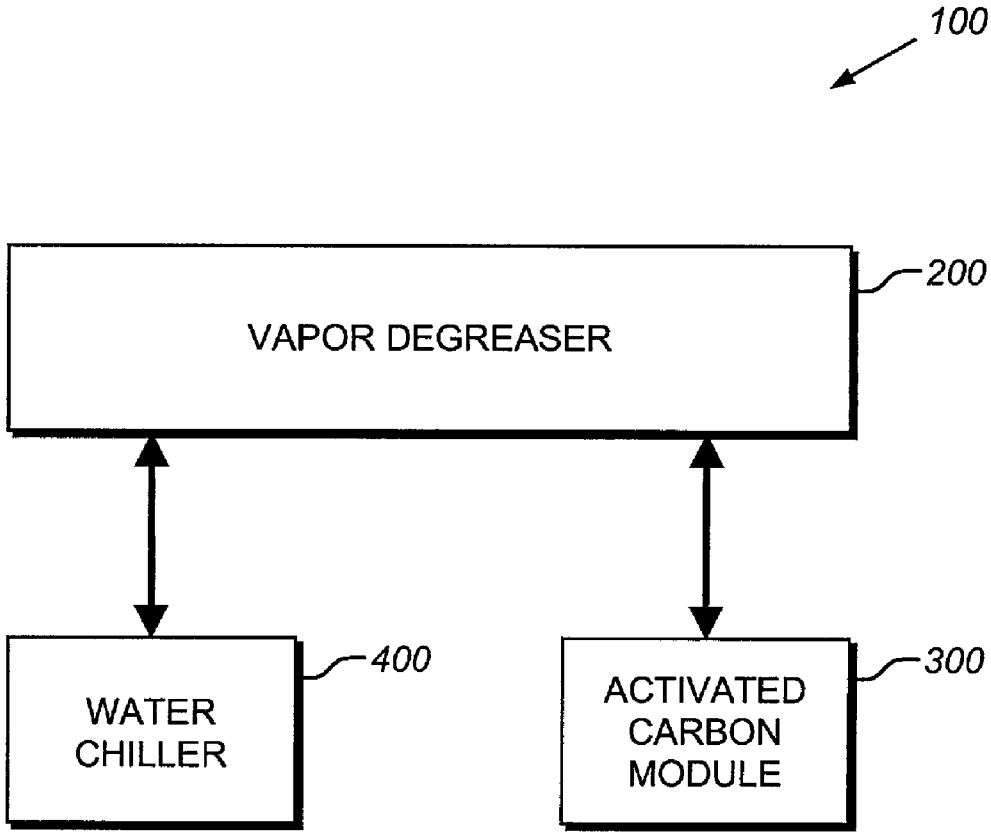
FIG. 2 is a block diagram of the decontamination system.

In FIG. 2, one embodiment of a decontamination system 100 is illustrated. The decontamination system 100 includes three modules: a vapor degreaser 200, a purification module 300, and a circulating water chiller 400. These modules are interconnected as shown in the process flow diagram shown in FIG. 5.

Figure 5:
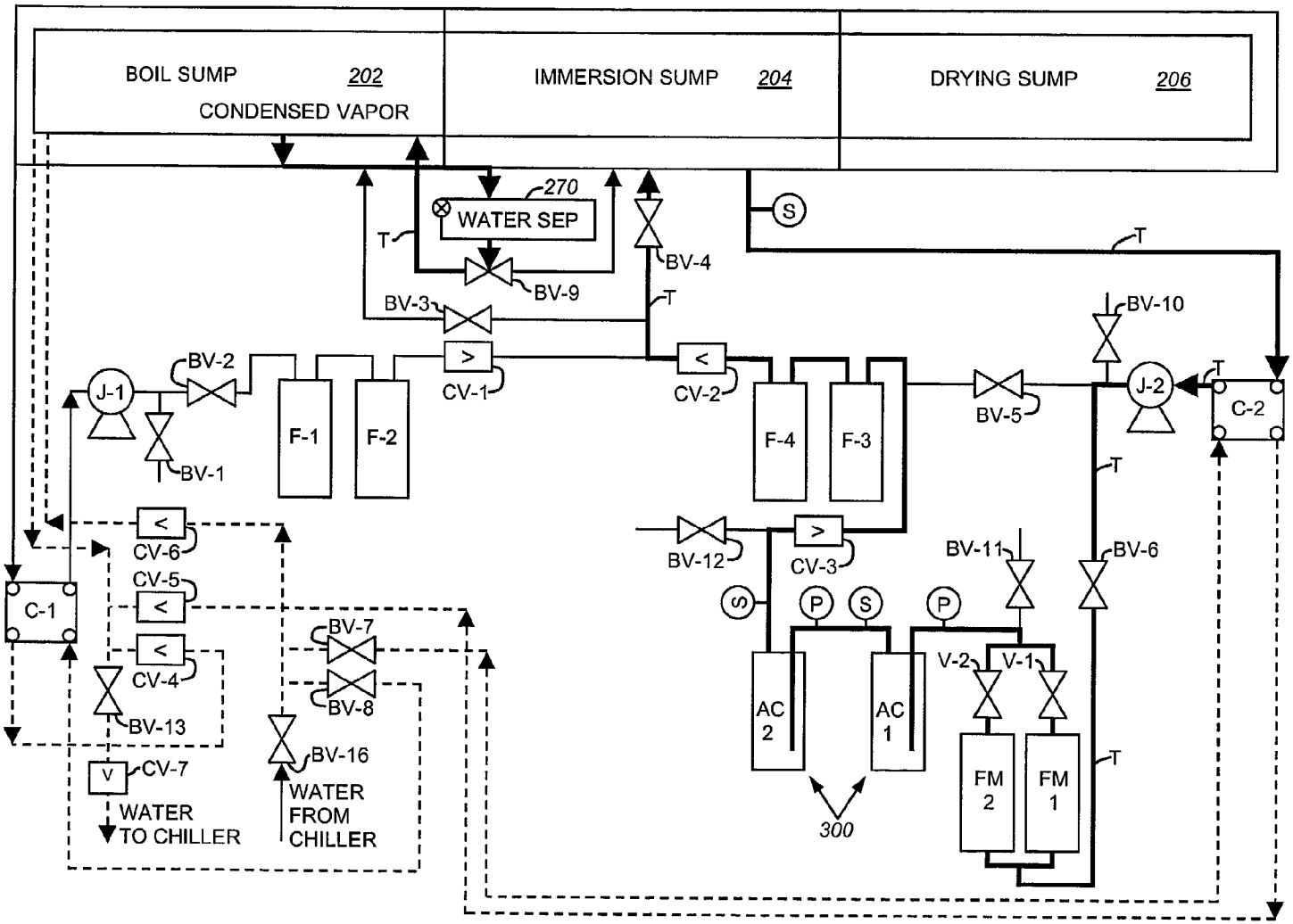
FIG. 5 is a process flow diagram of the system of FIG. 2 illustrating one embodiment of a system in a chemical activation mode.

The embodiment illustrated in FIG. 5, includes: activated carbon columns, AC-1, AC-2, ball valves BV-1 to BV-16, heat exchangers, C-1, C-2, control valves, CV-1 to CV-7, prefilters (4.5 microns rating) F-1, F-3, final filters (0.22 micron membranes) F-2, F-4, flow meters FM-1, FM-2, pumps J-1, J-2, pressure gauge/sensor P, contaminant concentration sensors (fluorimeter), and tubing T connecting the various parts.

Figure 3:
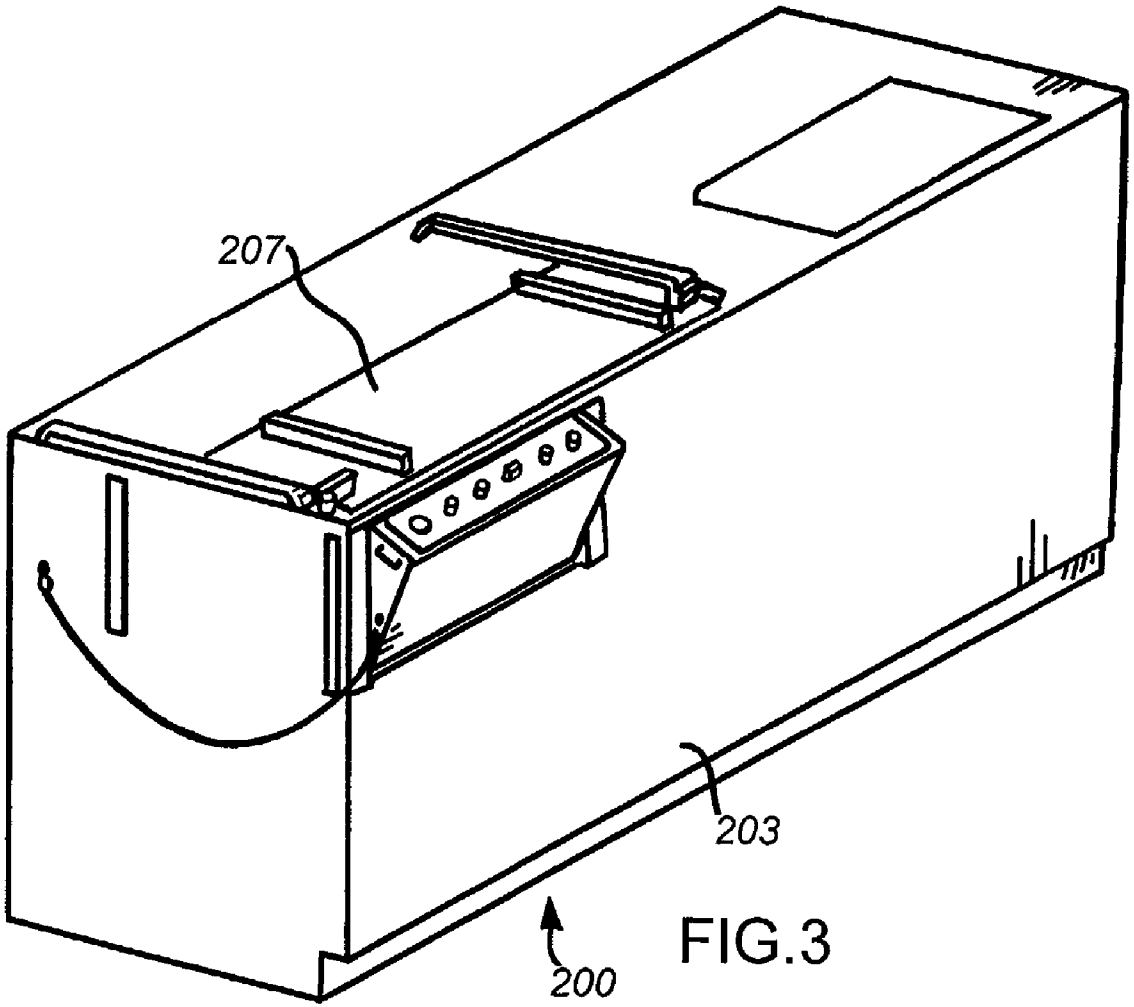
FIG. 3 is a perspective view of a degreaser of in one embodiment of the decontamination system.
Figure 4:
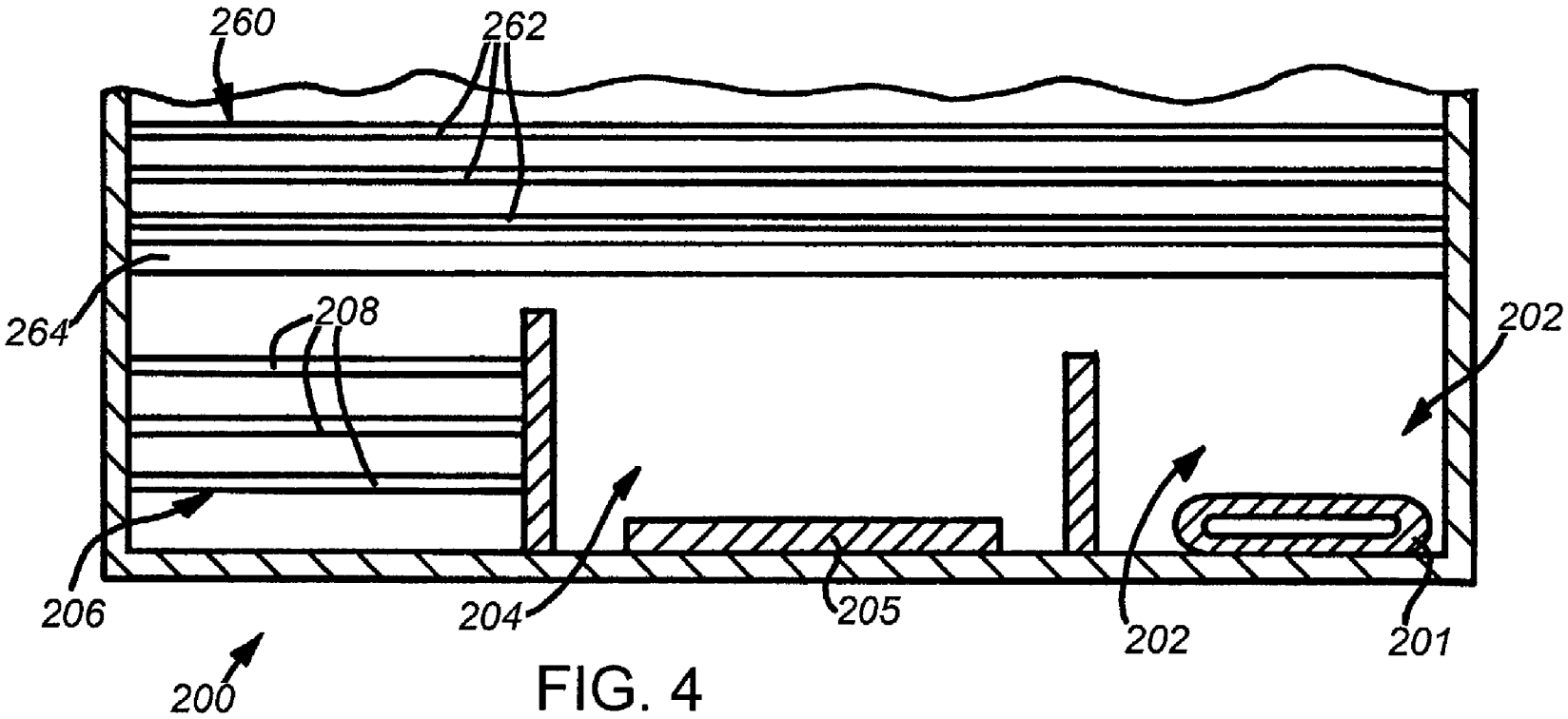
FIG. 4 is a generalized longitudinal schematic sectional view of the degreaser of FIG. 3.

As seen in FIGS. 4 and 5, the degreaser includes a boil sump 202, an immersion sump 204 and a drying sump 206. The sumps 202, 204, 206 are housed in a housing 203 (FIG. 3) having an access cover 207.

The boil sump 202 contains a heater 201, such as an immersion electric heater. Preferably, the heater is a low watt-density heater. The heater provides the energy needed to boil the decontamination liquid in the system. Decontamination fluid in the boil sump is continually distilled, i.e. the impurities concentrate in the boiling sump while the vapor phase of the decontamination fluid rises. This vapor circulates the decontamination fluid around the system The immersion sump 204 is filled with decontamination liquid. Liquid is introduced into the sump 204 through an entry port just below the liquid level. Liquid can be withdrawn from the sump 204 from a port at its bottom. If this port is closed, liquid accumulates in the sump 204 until the top lip is reached and liquid then overflows into the boil sump. The immersion sump 204 includes an ultrasonic transducer 205. The transducer can generate frequencies between about 40 kHz to 200 kHz to provide high intensity ultrasonic agitation.

The drying sump 206 is located to one side of the immersion sump 204. Immersion sump 204 is located between the boil sump 202 and the drying sump 206. The drying sump 206 is an enclosure that is lined with coil, such as corrugated Teflon® tubing 208 through which hot water heated to a temperature such as 85° C., by an external in-line heater (such as a Model 1104, 750 watt circulator), located in the back of the module, continuously circulates. The purpose of sump 206 is provide super-heated vapor that heats a basket of contaminated parts to a temperature higher than the boiling point of the liquid, and evaporates liquid left on the parts after removal from the immersion bath.

The immersion sump 204 and the boil sump 202 are fitted with a pumps J-1, J-2 and filter recirculation system (see FIG. 5) that can either pump these liquids to purification module 300 or to on-board filters F-3, F-4 to remove suspended particles from the liquids. This subsystem is preferably sized to provide a fluid recirculation rate of up to 3 gpm, or an immersion sump 204 liquid exchange rate of 0.2 volumes per minute, cycling the volume of the immersion sump through the filtration above every 5 minutes, or 12 times each hour. The pumps J-1, J-2 can be polypropylene, seal-less magnetic drive centrifugal units with totally enclosed fan cooled motors. The liquid is filtered through disposable 4.5 μm (F-3, F-4) and 0.2 μm (F-1, F-2) filter capsules that are enclosed in disposable polypropylene housings. Water-cooled stainless steel heat exchangers C-1, C-2 are respectively placed up-stream of the pumps J-1, J-2 in each circuit to prevent cavitation in the pumps J-1, J-2. Piping T is fabricated from ⅛ in NPT natural polypropylene.

The degreaser 200, as seen in FIGS. 3 and 4, also includes a condenser 260 having coils 262 (only three shown in FIG. 4). The solvent vapors condense when they come into contact with the peripheral condenser coils 262 and define a chilled condensate zone. The coils 262 are preferably corrugated polyethylene tubing which provide extended surface area for efficient solvent vapor condensation when chilled water is circulated through the coils. For efficient condensation, an inlet water temperature of from 2° C. (34° F.) to 5° C. (41° F.) is preferably maintained.

The condensed vapors collect in a trough 264 situated below the condenser 260. From this trough 264, the condensate (which may include some atmospheric moisture) flows into a chamber (the water separator 270) which provides sufficient residence time to allow entrained water to separate from the hydrofluorocarbon solvent by gravity. The floating water in the separator 270 is periodically purged from the system.

From the water separator 270, the condensed solvent can either flow into the bottom of the immersion sump 204 or back into the boil sump 202, as shown in FIG. 5. The system is operated in this form when it is desired to replenish the liquid in the immersion sump 204 with freshly distilled solvent. When this sump 204 is full, the solvent overflows back into the boil sump 202, thus closing the solvent circulation loop. The system 100 is operated in the latter mode when a vapor blanket is required, but it is not desired to replenish the immersion sump 204 with freshly distilled solvent nor have the contents of the immersion sump 204 over into the boil sump 202.

The decontamination system 100 also includes, as discussed above and seen in FIGS. 2 and 5, and purification module 300. The module 300, as shown, includes a primary set (referred to as AC-1 in FIG. 5) of four parallel activated carbon columns 306 and a secondary set 304 (referred to as AC-2 in FIG. 5) of two parallel activated carbon columns 306.

Referring to the process flow diagram of FIG. 5, the module 300 also includes in-line process components located between BV-6 and check valve CV-3 that may be mounted on an angle iron frame. The process components include in addition to the primary and secondary sets AC-1, AC-2 of carbon columns 306, a ball valve BV-6 which when closed, isolates the module 300 from the rest of the system, flow meters FM-1 and FM-2, which can have a range of from 0 to 0.7 L/min of HFE-7100 for FM-1, and 0 to 10.7

L/min for FM-2, and control valves, V-1 and V-2, which are used to control the flow rate of liquid through FM-1 and/or FM-2.

Figure 6:
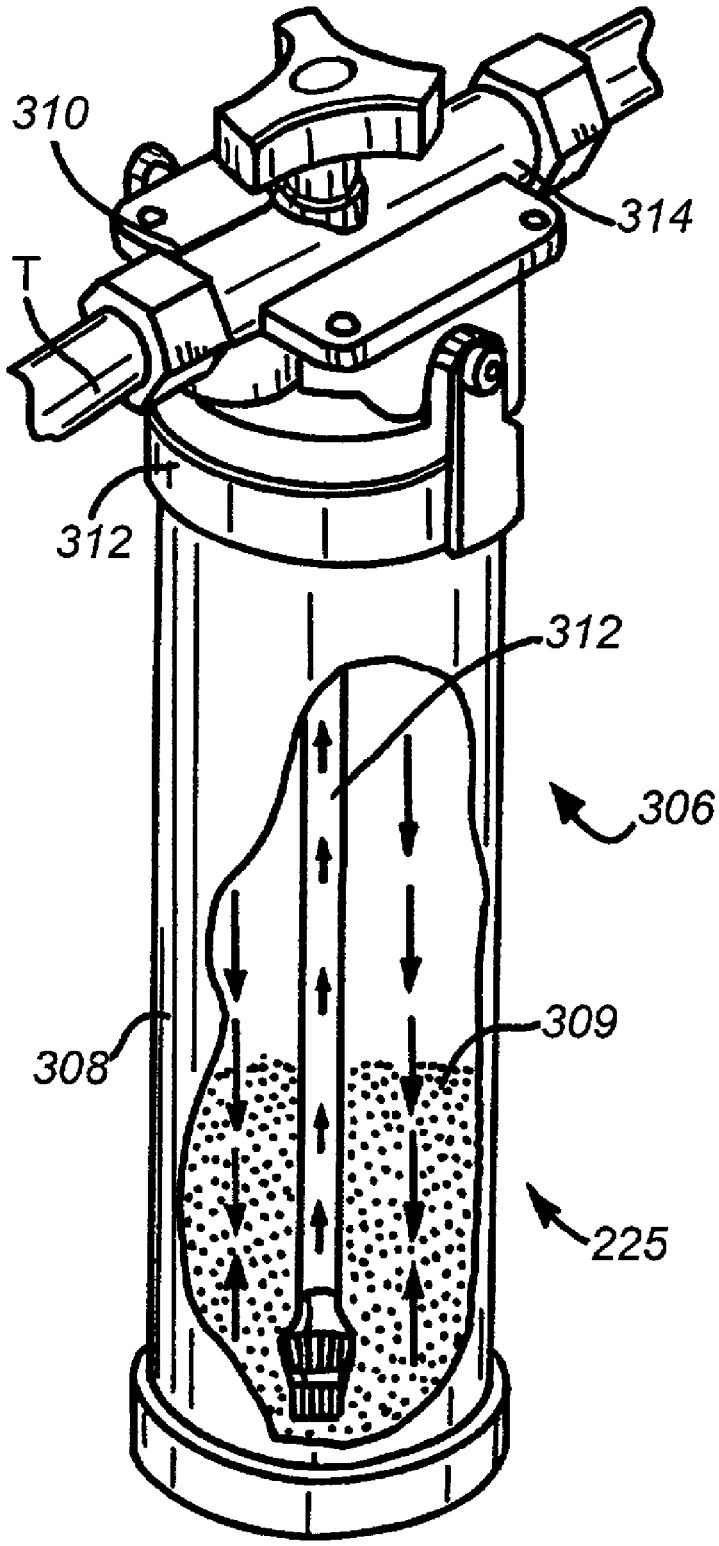
FIG. 6 is a perspective view, partially broken away, of an activated carbon column.

FIG. 6 illustrates one of the columns 306 forming the primary and secondary sets of columns AC-1, AC-2. The column 306 includes a cylindrical housing 308 preferably formed of polypropylene. The column 306 includes activated carbon 309 disposed in the housing 308. The liquid from tubing T enters an inlet 310 in a cover 312. The inlet 310 forms a pathway to the housing 308 and the activated carbon 309. The liquid flows through the pathway to the carbon and is expelled through a tube 312 to an outlet 314. The carbon absorbs CWAs from the liquid to allow the liquid to be purified and recirculated.

The activated carbon, preferably is amorphous and has a high surface area, above 500 sq. meters/gram, a broad pore size distribution including a large percentage mesopores. The carbon also has low resistance to liquid flow.

The activated carbon may be granular activated carbon such as that sold under the trade name Norit 1240 GAC (−12 mesh, +40 mesh activated carbon made by the Norit Co., Norcross, Ga.). The granular carbon is packed in the column 306 by conventional means. In addition to granular, activated carbon, fiber fabric such as that sold by Taiwan Carbon Technology Company, Limited under the trade name AM-1101 or activated carbon felt sold by the same company under the trade names AM-1131 or AM-1132 may be used. This felt of cloth may be packed in the housing 308 by conventional means.

The system 100 also includes, as discussed above, a cooling water chiller 400 that is sized to provide the required heat removal requirements (4.5 kWh at 5° C. (41° F.) was provided. Incorporating this chiller 400 into the system results in a self-contained system that only requires electric power for operation.

The system 100 is used as follows to decontaminate CWA from sensitive equipment. The immersion sump 204 is filled with decontamination liquid, such as, HFE-7100. The boil sump 202 is filled with boiling decontamination fluid. The resulting vapors of decontamination fluid condense on the cooling coils 262, and the condensate falls into the trough 264 and is returned either to the immersion sump or boil sump, depending on the mode of operation. The vapor blanket fills the unoccupied space below the condenser coils. While some vapor condenses in the slightly cooler liquid in the immersion sump 204, the temperature of the vapor space is essentially the boiling temperature of the decontamination fluid. Circulating hot water through the coils 208 in the drying sump 206 raises the temperature of this sump 206 above the boiling temperature of the decontamination fluid, thus preventing its condensation in this sump 206.

The equipment to be decontaminated is loaded into a wire basket or similar rack or suspended from a hook or hoist. The dimensions of the basket are such that it will fit in the immersion bath and in the drying sump.

After opening the cover 207 of the degreaser 200, the basket is lowered into the immersion sump 204 where the parts are exposed to sonicated liquid to remove soils and contaminants. The ultrasonic waves are generated by the transducer 205 in a known manner. The ultrasonic waves generate convection currents that sweep contamination away from the surfaces of the parts being cleaned. The decontamination liquid dissolves the CWAs on the equipment in the sump 204. The liquid in the sump 204 is then circulated through a purification train that continuously removes dissolved and suspended contaminants by one of two modes discussed below. Once the parts have been deemed to be clean, the parts basket is manually raised out of the immersion sump 204 and transferred to the drying sump 206. In this sump 206, liquid adhering to the cleaned parts is evaporated. The resulting vapors condense on the cooling coils 262 and do not escape from the system. The clean and dry basket of parts is then removed from the system 100. During the cleaning process, the cover 207 on the system 100 is closed except when the basket is transferred between sumps 204, 206.

Figure 7:
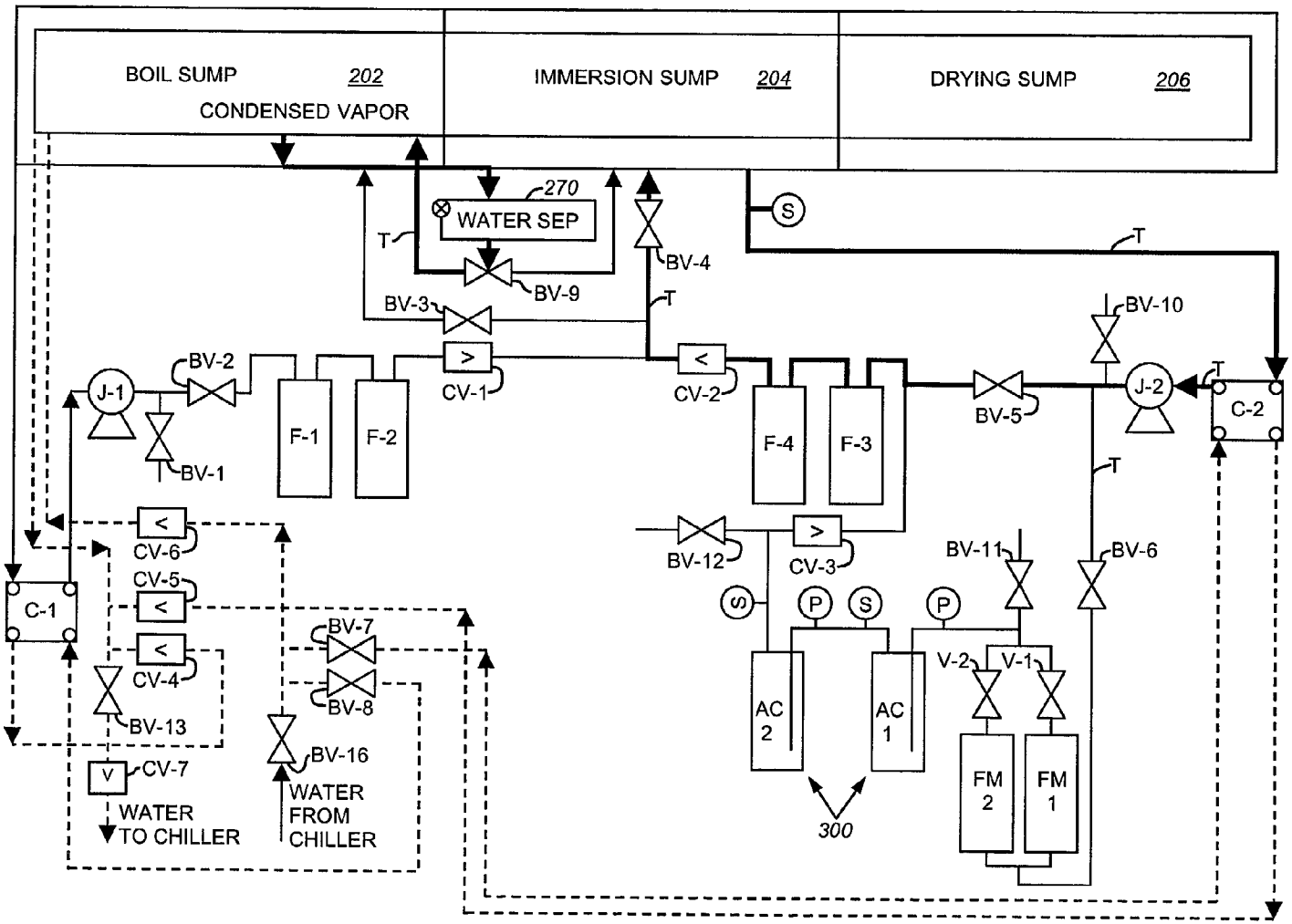
FIG. 7 is a process flow diagram similar to FIG. 6 illustrating one embodiment of a system in a chemical decontamination filter mode.

The first mode to purify the decontamination liquid can be referred to as the Chem Decon Filter Mode and is illustrated in FIG. 7, where ball valve BV-6 is closed isolating the activated carbon module 300 and ball valve BV-5 is open. The pump J-2 takes decontamination liquid through tubing T to filters F-3, F-4 which remove suspended insoluble contaminates from the liquid and returns decontamination liquid free of the suspended insoluble contaminants to the immersion sump 204 (the flow path of the liquid is seen by the bolding of the tubing (T) lines in the various figures).

After the Chem Decon Filter Mode, is run the apparatus is set to run in the second liquid purifying mode, the Chem Decon Activated Carbon mode, illustrated in FIG. 5. In this mode, ball valve BV-6 is opened and ball valve BV-5 is closed. Decontamination fluid is circulated by pump J-2 through the tubing T to the primary and secondary sets of activated carbon columns AC-1, AC-2, then through prefilters F1 and F2 and back to the immersion sump 204. The dissolved CWAs in the decontamination fluid liquid passing through the activated carbon of columns 306 of sets AC-1 and AC-2 are adsorbed thereon. Samples are manually or automatically taken from the tubing T immediately connected to immersion sump and analyzed at a sensor(s) to determine if the liquid in the immersion sump is free of CWAs. The decontamination liquid is recirculated in this manner until analysis shows the decontamination liquid has an acceptable level of liquid and it is free of contaminants. The sensor(s) may measure indicators such as a fluorescent dye. In the case of a fluorescent dye the sensor(s) is a fluorimeter. Ideally, the decontamination fluid will have no CWA agent. Preferably, a concentration of CWA below the detection limit of the sensor, but at least a concentration that is not immediately dangerous to life or health of persons who may come in contact with the recycled fluid.

Because equipment can be contaminated by thousands of possible contaminants, a practical way of being able to monitor the rate of decontamination in the field is to spray a fluorescent simulant on the equipment to be decontaminated, and then use fluorescence of the process stream to monitor the rate of decontamination. Fluorescence has the great advantage of being very sensitive method—we can measure to 10 parts per trillion of fluorescent dye, which is equivalent to a concentration of 1 ppb of simulant that has a fluorescent dye content of 1%. Once the fluorescent dye can no longer be detected, the decontamination liquid is substantially free of CWAs. (Sensors S are also located immediately after the primary and secondary sets AC-1, AC-2 of carbon columns. If CWAs are detected by these sensors, the operator knows the columns 306 are no longer adsorbing CWA and must be replaced or recharged.

As discussed above, the basket is then manually taken out of the immersion sump 204 and placed in the drying sump 206 where any decontamination liquid remaining on the equipment is evaporated.

Figure 10:
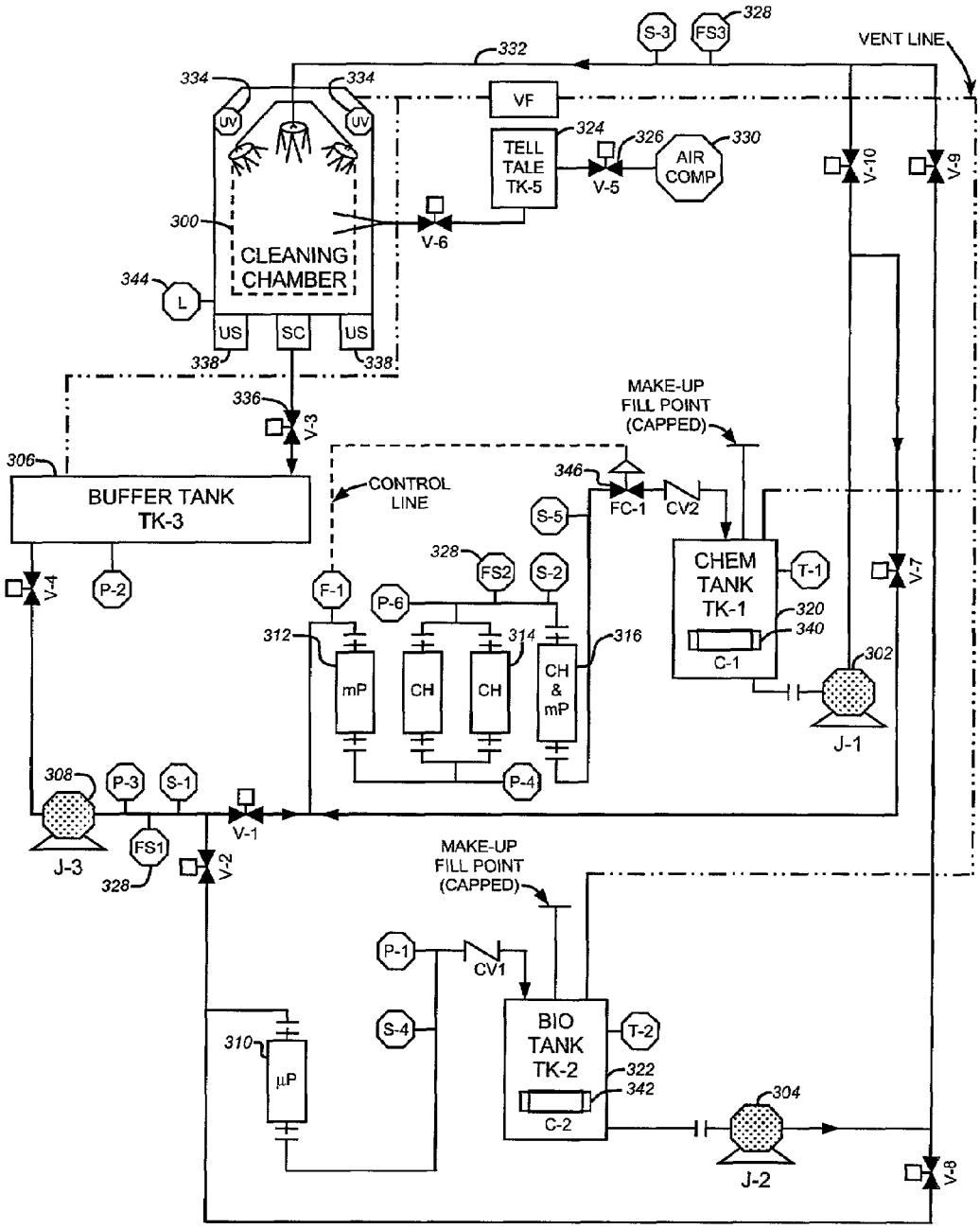
FIG. 10 is a process and instrumentation diagram of another illustrative embodiment.

A process and instrumentation diagram for another embodiment of the proposed system is shown in FIG. 10. In this illustrative embodiment, the principal pieces of process equipment are:

a. A decontamination chamber 300 large enough to accept items to be decontaminated.

b. A cleaning cabinet containing:

1) Two high-rate liquid transfer pumps 302, 304 for rapidly filling the cleaning chamber.

2) A buffer tank 306 to allow cleaning and liquid recovery to occur in parallel.

3) A filtration pump 308 with automatic flow regulation for maximizing the removal efficiency of the carbon filter and the retention of agent in the carbon filters.

4) A biological micro filtration module 310.

5) A chemical prefilter 312 and final filter 314.

6) Heated solvent storage tanks 320, 322 to maintain the cleaning liquids at optimum temperatures.

7) A telltale storage tank 324 and injection mechanism 326, and sensors 328 to monitor telltale concentration in the process liquids.

8) A compressed air supply 330 for control valves and injecting telltale.

All the components can conveniently be integrated in the principal system component or cleaning cabinet.

Figure 11B:
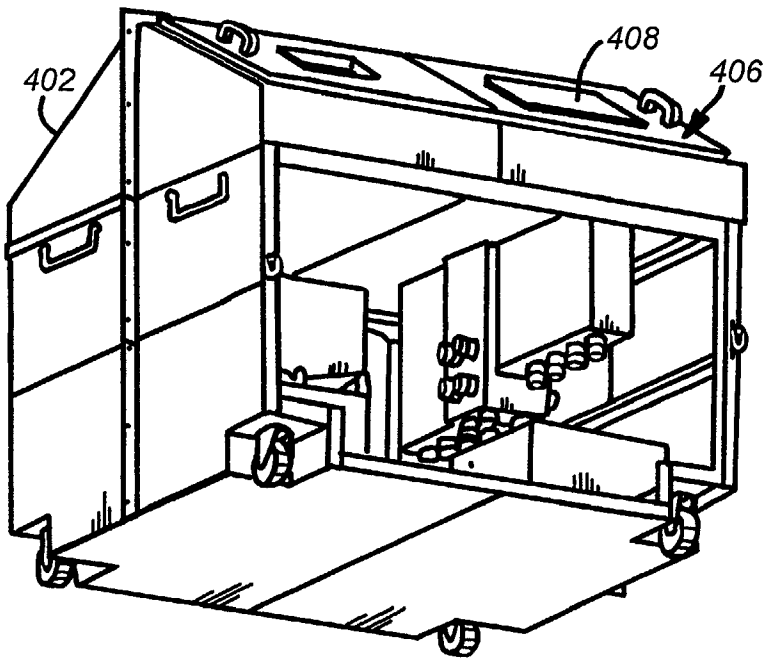
FIG. 11B is a rear perspective view of the system of FIG. 11A.
Figure 11A:
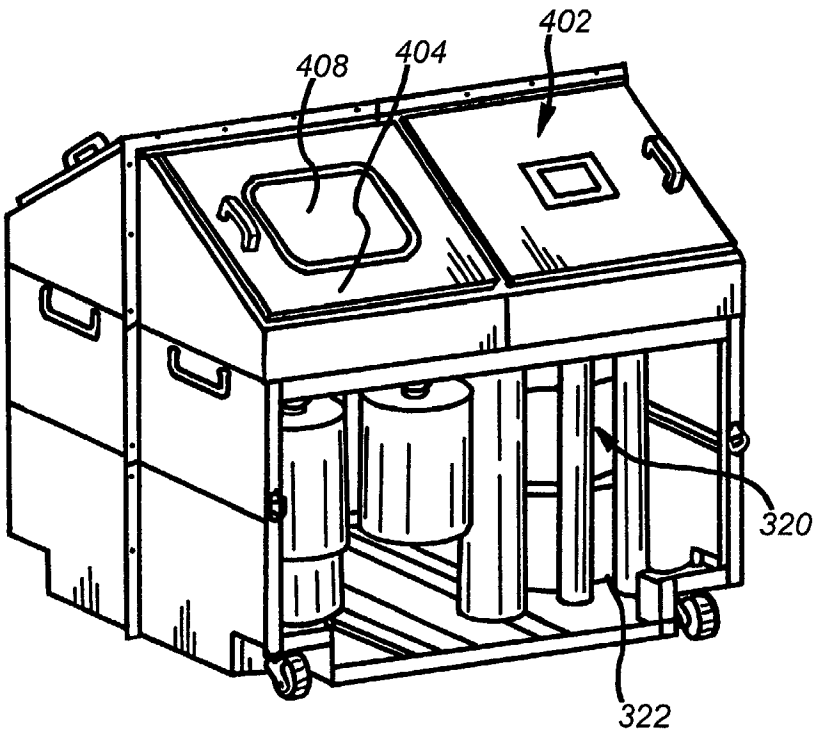
FIG. 11A is front perspective view of an embodiment of a system.
Figure 13:
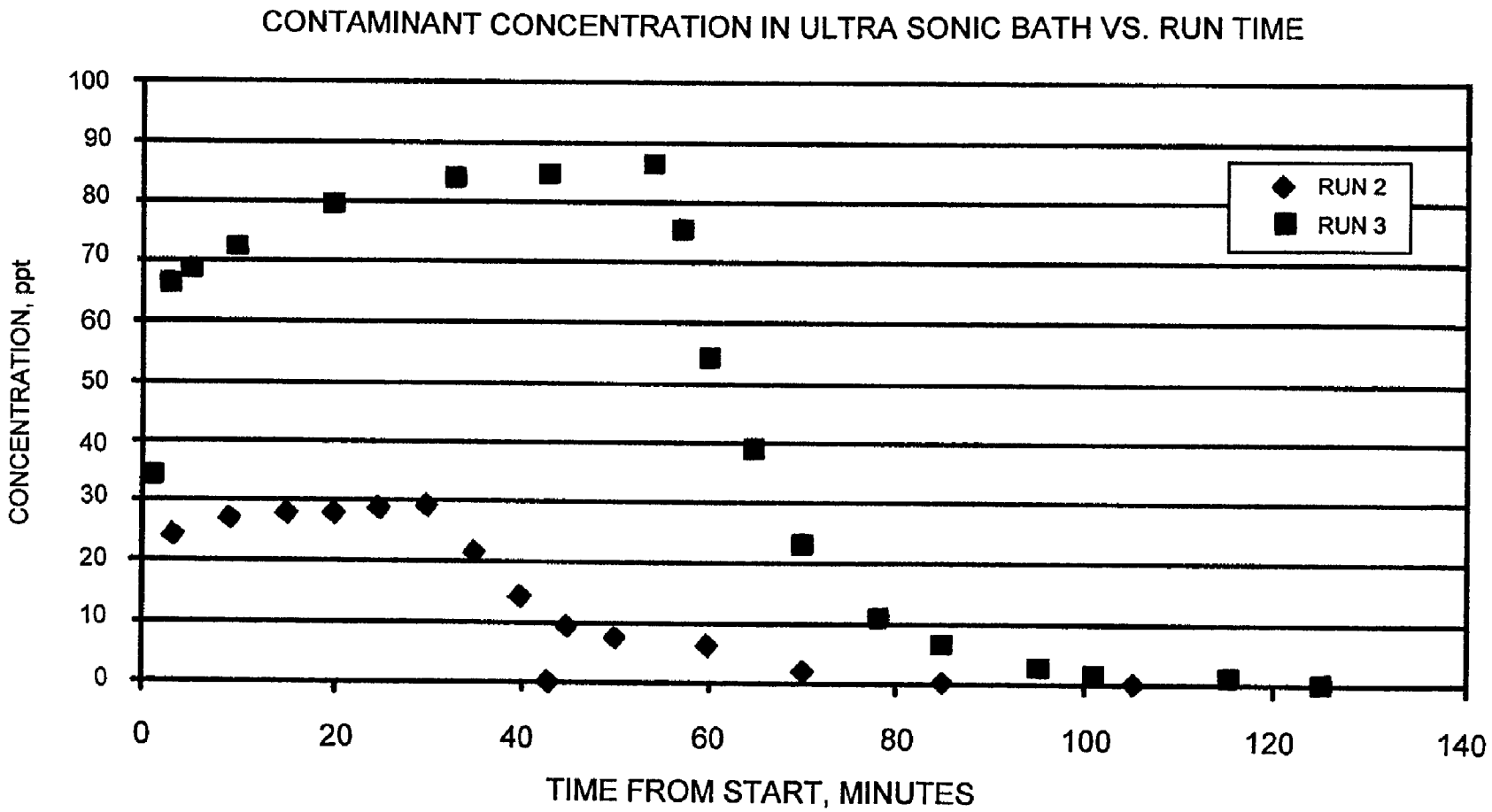
FIG. 13, is a graph showing the concentration of contaminant is an ultrasonic bath as a function of time in one embodiment of the invention.

As shown in FIGS. 11 to 13, the cleaning cabinet is a welded 304 stainless steel unit. The cabinet is compatible with chemical warfare agents, decontamination solutions, soap and water, and salt water. It can be decontaminated by currently established methods. The cleaning cabinet also contains the following components:

a. Power conditioning Unit b. Power distribution panel c. Ultrasonic Power Supply d. Process Controller e. Control air manifold f. Operator's panel The upper sides 402 of the cabinet 400 preferably are sloped to allow contaminated equipment to be introduced through a hinged door 404 on one side, and decontaminated equipment to be removed from a similar door 406 on the opposite side. During operation, both doors are preferably gasket-sealed with cam-operated latches and interlocked automatically to isolate the chamber from the environment. Decontamination liquid is introduced to the chamber through spray manifolds 332 that wash down the walls of the chamber and the parts during the filling process. Two 360 nm ultraviolet inspection lamps 334 are mounted above each door. The doors have observation windows 408. These lamps allow the operators to examine the processed parts through the windows in the doors for residual traces of a fluorescent telltale. A support rack 1" above the chamber floor prevents the processed items from touching the floor of the chamber. This floor is sloped to facilitate liquid drainage. The liquid is removed from the bottom through a large quick opening valve 336. A screen strainer prevents small objects from going through this valve, and possibly jamming it. Multifrequency ultrasonic transducers, 338 which can operate at frequencies in the range of from about 40 kHz to about 170 kHz, are acoustically coupled to the bottom and sides of the chamber. These transducers are controlled by a conventional power supply that preferably has the following characteristics:

a. At least about 720 watts of output at frequencies in the range of about 40 to about 170 kHz.

b. Selectable center frequencies of within the range, including for example 40, 72, 104 or 170 kHz.

c. Has full amplitude, sweep function over a programmable bandwidth optimized for each frequency.

d. Sweep and DualSWEEP™ frequency variation.

e. DualSWEEP™ rate of about 37 Hz (frequency at which the sweep rate changes between 380 Hz and 530 Hz).

f. DualSWEEP™ bandwidth of about 150 Hz.

g. 0 to 5 volt DC control of power (10% to 100% output power variation).

h. Output power measurement of 0 to 5 volt DC (calibrated as 200 watts/volt).

i. Drives 18 advanced transducers.

CWA and other contaminants dissolved in the effluent decontamination fluid from the cleaning chamber, as well as any suspended water, will be removed from solution/suspension in decontamination fluid by adsorption onto activated carbon.

In order to prevent the chemical filter from clogging, the design incorporates a high-dirt load capacity prefilter 312. One example of a prefilter is a 20" long P all 18 micron stainless steel Rigimesh™ cartridge filter in a stainless steel housing. This filter assembly is fitted with quick disconnect fittings that incorporate dual shut off valves. The Rigimesh™ filter is a low-pressure drop filter. Other filters with similar characteristics will be apparent to those of skill in the art.

In the illustrated embodiment, the activated carbon adsorption module includes two parallel canisters, 316 10" in diameter and 11" high, and each weigh about 50 lbs. when filled with liquid. In this example, the vessel contains approximately 0.44 $ft^3$ of activated carbon felt wrapped around a ¾" perforated stainless steel mandrel. The ends of the felt are sealed to prevent bypass flow. Of course, the number of parallel adsorption canisters can be increased to any convenient number, and the size of each canister, or the amount of adsorbent in the canister may be varied as desired to accommodate varying needs of users. It may be advantageous to use adsorption canisters with a manageable size and weight when canisters are to be changed in the field. However, when suitable equipment is available, larger, heavier canisters may be used.

The module is flushed with clean solvent before changing the filter to remove any chemical agent present in drips of potentially contaminated liquid that form when the self-sealing hose connections are dismantled.

The design also includes a final adsorber/filter module on the feed line to the cleaning chamber. This final filter provides an additional adsorption barrier to prevent downstream migration of CWA and of activated fiber fragments and other particulates into the cleaning chamber. This filter capsule is similar to the activated carbon module in construction except that it is 6" in diameter and 21" long, and weighs 33 lbs. In this module, layers of activated carbon fabric are wrapped over a 1" mandrel whose center section is a 2-micron microporous stainless steel filter.

A dye tracer, such as Try 33, Day-Glo Company may be applied to monitor the CWA decontamination process and the adsorption effectiveness of the carbon filters. A fiber optic probe 328 will detect the presence of dye at the inlet to the prefilter and at the inlet and outlet of the final chem. filter/adsorber module. The probes are integrated into the cleaning module, so that no probes must be connected in the field. The approach used in this system is an adaptation of existing spectroscopic techniques for analysis of contaminants in inaccessible locations by use of fiber optics. In use, an operator may determine when the cleaning process is complete and when the carbon filters are saturated by measuring the tracer dye's fluorescence. A fiber optic sensor will allow such measurements to be made in real time without exposing the operators to the solution being tested.

Fluorescence measurements require generation of excitation light of a suitable wavelength and detection of emitted fluorescence typically at another wavelength. Using a disposable fiber optic probe in the filter allows the excitation and detection functions to be housed in the electronic module in the cleaning cabinet. The design proposed here builds on our experience with building fiber optic sensor systems to measure fluorescent contaminants in surface and ground waters, and in the vapor phase. The presence of dye tracers in simulated bedrock ground water systems have been measured with limits of detection in the ppt range.

In this case, the Try 33 dye used as an indicator fluoresces in the range between 450 and 550 nm when excited by light in the range between 350 and 450 nm. This difference will allow use of a solid-state excitation source and a solid-state detector, both being rugged and having long operational lifetimes. The light source is similar to those designed and used for a variety of geophysical applications.

Solid-state low power devices, as in this example, require a minimal power supply to operate and can be configured to use battery backup. Small size is an advantage, with the light source module expected to fit within a 3" wide by 5" long by 1" deep box. There will be three light source modules in the cleaning cabinet—one for each of three sensing points in the chemical filter. The programmable logic controller will test the fluorescence sensors as part of the self-check routine.

Pumping requirements for these applications are up to 15 gpm at 15 feet of head. In the illustrated embodiment, three pumps are required. Price Pumps Model CMI0ANI-494-31110-75-18-1X6 stainless steel pump, with a trimmed impeller to handle the high density liquids, driven by a fractional horsepower explosion proof motor have been effective. Other pumps will be apparent to those of skill in the art.

In operation, Pump 302 will be used to transfer decontamination fluid from the chemical module to the cleaning chamber, and to circulate through heat exchanger 340. Pump 304 serves the same function for the decontamination fluid surfactant solution. Pump 308 will be used to transfer process fluids from the buffer tank through either the biological or chemical filters and back to the storage tanks.

The decontamination fluid (TK-1 rinse) supply tank 320 and the surfactant solution tank 322 (TK-2 wash) are incorporated into the cleaning cabinet. To facilitate loading, each tank will be provided with a chained gas tank type closure. The caps will be of different shape and size to prevent mis-supply.

Each tank will contain heaters and temperature controls to maintain the system at a temperature range of about 30 to 45° C. The process will operate over a temperature range from about 15° C. to about 50° C. The solubility of mustard (a CWA of interest) is a function of temperature, increasing with increasing temperature. Under ambient conditions, ultrasonic energy applied to the liquid being sonicated will rapidly raise it from ambient to about 30° C. However, when the system has to operate in a cold (sub-zero) environment, auxiliary heating is required to bring the process liquids to a suitable operating temperature.

Tank TK-3 is a buffer tank 306 that decouples purification of the effluent liquid from the cleaning chamber from the cleaning of contaminated parts. This allows the contaminated liquid from a prior cleaning cycle to be purified while a new load of parts is being cleaned. Having a buffer tank allows more time for the purification steps and more cleaning cycles. This is especially important for the removal of CWA by activated carbon. By providing more residence time, the size of the activated carbon bed required for operations becomes significantly smaller.

Stainless steel tubing of an appropriate size, with compression fittings is a preferred method for forming permanent liquid connectors to minimize crevices and beads that may lead to contamination entrapment. A composite hose with an impervious nylon lining (to retain the decontamination fluid, a synthetic fiber overwrap (for strength), and a polyurethane cover (to provide CWA, UV, and abrasion resistance) such as Swagelok® Type 8R thermoplastic hose with stainless steel tube adapter ends can be used for liquid connectors to filters that can be attached or detached during system operations. Of course, other materials may be used for fluid connections.

Fluid flow will be controlled by full port stainless steel ball valves of an appropriate size. In operation, the valves are preferably automatically operated by an automatic process controller. Preferably, double acting valves setup in a normally closed arrangement are used. Spring-loaded double shut off valves will be used to prevent loss of liquid contained in the flexible tubing upon dismantling.

The principal operator interface will be used to control and monitor system operations. The user will have a choice of operating in an automated mode under the control of a programmable logic controller (PLC), or in a manual mode for diagnostic purposes. RUN and STOP buttons, as well as status lights, will be located on both sides of the cleaning cabinet as required. The operator on the clean side can select to start a run, read diagnostic messages, or control any component manually through the PLC. The PLC will be able to apply different process sequences depending on the task to be performed. The PLC will also track the run time of the system.

The PLC will also be programmed to conduct a test sequence during startup operations to verify that the system is operable. This test will include a verification that the flow meter, level gauges, pressure sensors, and chemical sensors are operable and providing consistent readings. The PLC and status panel will notify the operator(s) when filters need to be changed. The PLC will automatically test the replacement filters before use.

The PLC will stop the operation of the system if a failed component is detected and indicate the nature of the failure. The air-operated valves will revert to the closed position if the operator or the PLC requires an emergency stop.

The use of a PLC simplifies system upgrades and provides process versatility to adapt to changing requirements (such as new agents).

When the operator has filled the on board tanks, the operator then connects electrical power. Pressing the POWER ON button will cause the PLC to run through a startup sequence of tests. If the liquids are too cold, they will be heated by heat exchangers 340 and 342 until they reach a predetermined temperature.

The automated tests include operation of pumps, calibration correlation of flow meters and level gauges, tests of optical sensors (embedded fluorescence sources in filters), verification of correct differential pressures, available compressed air, and self-diagnosis of the PLC itself. The startup test provides an internal calibration check of flow, level, pressure and chemical sensing. The display will list the tests as they are performed and end with a message that the system is ready to clean or indicate what is needed (e.g. "replace bio filter" or "add chemical solvent"). Most tests can be performed while the solvent is being heated.

The operator can now open the contaminated side door to insert items and press the RUN start command on the control display.

The operator will place the items to be decontaminated directly on a support at the bottom of the cleaning chamber.

When the operator presses the run button, the system doors are sealed. Telltale is then applied automatically. The system then proceeds with a chemical and a subsequent biological cleaning step.

The parts being processed are not considered clean as long as the liquid leaving the chamber exhibits a measurable fluorescence. Once the fluorescence of the liquid leaving the cleaning chamber falls below a preset value, or is no longer detectable, the parts being decontaminated are no longer contaminated by the telltale, and, no longer contaminated by CWA. A second use of the telltale will be to monitor loading and breakthrough of the activated carbon beds. The adsorption characteristics of the telltale onto activated carbon are similar to those of CWA of concern.

After the contaminated equipment is placed in the chamber through the contaminated side door, the doors are locked by the PLC, so that the interior of the system is isolated from the environment, and telltale is applied automatically. Clean decontamination fluid is pumped from the tank 320 by pump 302 via a multi-directional inlet liquid spray manifold 332. A level sensor 344 determines when the cleaning chamber is filled with solvent. The sensor is needed to prevent overfilling the tank, which would reduce the cleaning effectiveness by reducing the ultrasonic power density. Once the chamber is filled with liquid, it is sonicated for a preprogrammed period of time. The contaminated liquid is then dumped out of the chamber into a buffer tank through a 4" diameter valve 336 at the bottom. Before closing the bottom valve, the chamber is sprayed for five seconds to wash down the parts and remove contaminated drag out liquid. Once the bottom valve is closed, the chamber is refilled, and sonicated as before.

The liquid in the buffer tank 306 is pumped by pump 308 through the activated carbon felt module at a flow rate that allows adequate residence time in the filter to remove the CWA from the solvent. The flow control valve 346 limits the flow rate through the carbon felt filter. This module removes the dissolved contaminants from solution, to allow recycling of the decontamination fluid to the storage tank 320. Using a buffer tank allows the second and subsequent sonicating steps to proceed while the contents of the buffer tank are being processed through the filter. This arrangement significantly decreases the required time to complete a cycle.

When simulant contaminated parts were immersed and statically sonicated in decontamination fluid, for well sonicated parts, the simulant concentration in the immersion liquid reached the level expected from the amount of simulant originally deposited on the test parts within two minutes of immersion. While it is not possible to quantify accurately the removal of contaminant from the parts in the first minutes from these tests, the data clearly indicate rapid dissolution of contaminant in the solvent. The data also indicate that simulant thickened with Rohm & Haas Acryloid K-125 polymer dissolves, and that the thickener appears to be physically removed from the surfaces of the parts that are exposed to ultrasonic agitation.

The maximum amount of contamination initially present on a contaminated part that is introduced into the cleaning chamber results in very dilute solutions. As an example, assume that a 30"×4"×5" parallelepiped is placed in a 5.2 gallon cleaning chamber. The volume of this parallelepiped is 60 $in^3$ (or 9,820 cm). Taking into account the volume of the immersed object, the chamber will contain about 2.6 gallon of cleaning liquid (HFE-7100). The external surface of this object is 0.187 $m^2$. Thus, at the NATO standard load of 10 $g/m^2$, the part will be contaminated with 1.87 grams, or about 1.5 ml of CWA with a specific gravity of 1.2. Dissolving the entire agent load will result in a CWA concentration of about 0.015 vol-% CWA.

The rate of agent dissolution from the surface of the parts will be mass transfer limited, with the driving force for mass transfer decreasing as the residual concentration on the surface of the part decreases. To achieve maximum agent removal the parts to be decontaminated will be subjected to repeated cleaning cycles. Preferably the parts will be subject to at least three cleaning cycles of increasing duration. A possible cleaning method, illustrating the use of multiple cleaning cycles is summarized below:

| STEP NO. | STEP | STEP TIME (MIN) | CUMULATIVE CYCLE TIME (MIN) Chem. Cycle | Total |
|---|---|---|---|---|
| 1. | Place parts in Chamber | 0.5 | 0.5 | 0.5 |
| 2. | Rinse 1 Liquid Fill | 0.5 | 1.0 | 1.0 |
| 3. | Rinse 1 Sonicate | 0.5 | 1.5 | 1.5 |
| 4. | Drain and Post-rinse | 0.5 | 2.0 | 2.0 |
| 5. | Rinse 2 Liquid Fill | 0.5 | 2.5 | 2.5 |
| 6. | Rinse 2 Sonicate | 1.5 | 4.0 | 4.0 |
| 7. | Drain and Post-rinse | 0.5 | 4.5 | 4.5 |
| 8. | Rinse 3 Liquid Fill | 0.5 | 5.0 | 5.0 |
| 9. | Rinse 3 Sonicate | 2.0 | 7.0 | 7.0 |
| 10. | Drain and Post Rinse | 0.5 | 7.5 | 7.5 |

Another element of this strategy is to modulate the mix of ultrasonic frequencies that will be used. The resistance to mass transfer is proportional to the thickness of the boundary layer of quiescent liquid at the surface of a part. This thickness, in turn, is pro-portional to the length of the ultrasonic waves generated in the liquid, or inversely proportional to the frequency of the ultrasound being generated. The ability to sequentially vary the frequencies of the applied ultrasonic waves is a unique capability of the CAE multiSONIK™ ultrasonic power supplies. During the initial rinse (Rinse 1), the ultrasonic frequencies will be biased towards lower frequencies (i.e. down to 40 kHz). With progressive rinses (Rinses 2 and 3), greater emphasis will be placed on applying higher frequencies (up to 170 kHz).

The lower the concentration of agent in the solvent, the faster its rate of dissolution into that solvent; and in turn, the faster the rate of diffusion of agent in the paint film.

This process sequence is repeated until the fluorescence detector placed on the outlet line of the chamber indicates that the level of fluorescence in the liquid is no longer detectable.

The second part of the process is the removal of biohazards. In this mode, parts that are free of chemical contamination are first contacted with a solution of Krytox 157FS surfactant in decontamination fluid, followed by a decontamination fluid rinse. Biological particulates are removed/deactivated through the combination of surfactant adsorption on the organism being removed and ultrasonic agitation. The suspended material is then removed from the liquid by filtering the decontamination chamber effluent liquid through a bank of pharmaceutical grade 0.2-micron filters 310. The clean liquid is then returned to storage tank 322. The pressure drop across the filters is used to monitor filter loading and integrity.

Once the biohazard has been removed, the parts are rinsed with decontamination fluid to remove residual surfactant, and are then removed from the system. The parts are allowed to drain for a few seconds, and then the clean side door is unlocked by the PLC. The PLC will also unlock the contaminated side door after the clean side door is closed. Both doors cannot be open simultaneously.

Tests show that this method is effective to remove CWA simulants and other soils from representative items of sensitive equipment by sonication in decontamination fluid.

The data show:

a. the removal of a wide range of contaminants, including thickened agent simulants, and soils from representative items of sensitive equipment,
b. the kinetics of the decontamination process,
c. the removal of CWA simulant from the decontamination solvent by activated carbon adsorption,
d. means of monitoring the decontamination and adsorption processes.

Cleaning trials were performed with the following pieces of sensitive equipment

1. Auto-Ranging LCD Digital Multimeters, Model No. 22-179A, Radio Shack, A Div. of Tandy Corp., Fort Worth, Tex. 76102.
2. Electronic Calculator, Model No. EC-441, Radio Shack, A Div. Of Tandy Corp., Fort Worth, Tex. 76102.
3. Global Positioning System (GPS) receiver, Model No. GlobalNav 212, Serial No.005263360, Lowrance Electronics, Inc., Tulsa, Okla.
4. Night Vision Binoculars, Model RO 38, 4×48 Nighthawk, Serial No. 982331, with Model RO45, Zoom IR Illuminator, LAN Optics International, Burlington, Mass. 01803.
5. 7.65 mm semi-automatic pistol, Model PP, Carl Walther GmbH Sportswaffen, Ansberg, Germany
6. Inverter Circuit Boards, 1.5 inch square, designed by Entropic Systems, Inc.

Numerous tests were performed with digital multimeters, which were considered to be good prototypes for sensitive equipment. These items performed a number of electrical functions, they had a liquid crystal display covered by a clear plastic window, they contained a variety of materials that would be damaged by many solvents, and were inexpensive enough (about $12.00 each) to be considered disposable test items. The GPS receiver (Item 4) and the Night Vision Binoculars had previously been included in the list of items used for process compatibility testing (see chapter 5.0).

In addition, some tests were performed with other items to test the effects of part geometry. These items included standard 1"×3" microscope slides (standard flat surfaces), brass pipe nipples (easily accessible interior surfaces), and magnet assemblies (difficult to access interior surfaces). A magnet assembly consists of a ½ in diameter circular piece of stainless screening (typically 100 mesh) that is sandwiched between two ½" diameter by ¼" high cylindrical Alnico magnets. The soil is deposited on the screen before forming a magnet sandwich. This sandwich is then subjected to a cleaning trial. The changes in weight of the assembly, and in the appearance of the screen, are measures of the effect of the cleaning trial.

The test pieces were contaminated with a variety of neat and thickened CWA simulants and other soils. These are listed in Table 6.

CWA simulants used in these tests were diethyl phthalate (DEP), tributyl citrate (TBC), and Krytox 157 (L) and (H) fluorosurfactants. These materials are all water insoluble oils that have a low vapor pressure at ambient. They also all are miscible with HFE-7100. It was originally planned to use diethyl phthalate (DEP) as a model simulant, since its physical properties of are similar to those of VX, as noted in Table 2. DEP is also a commercial plasticizer, and was found to attack and dissolve in the plastics used in some of the test items. There were no materials compatibility issues with the use of Krytox 157FS as a simulant.

The CWA simulants were all doped with a fluorescent dye that greatly facilitated their detection on the test pieces and in the decontamination liquid. TRY-33 Fluorescent Dye, a product of the Day-Glo Corporation, Dayton, Ohio, was selected as the preferred tracer material. This was based on detection sensitivity, solubility in the simulants, stability and safety. Try 33 was soluble in DEP, TBC, and the Krytox 157FS surfactants, and the doped simulants all dissolved in HFE-7100. Try-33 was not soluble in Krytox AZ oil, which is a decarboxilated analog of Krytox 157FS(L), indicating that it is solubilized in Krytox 157FS by the carboxylic acid end groups of the Krytox 157FS molecules.

In some of the tests, a thickener was added to the simulant to mimic the behavior of thickened CWA agents. Two different types of thickeners were used: fumed silica

TABLE 6

Contaminants Used in Sensitive Equipment Decontamination Experiments

| Code | Carrier Liquid | Thickener | Thickener Conc., wt-% | Fluorescent Dye | Fluorescent Dye Conc., wt-% |
|---|---|---|---|---|---|
| DEP-1 | Diethyl Phthalate | none | 0 | Try 33 | 0.3 |
| TBC-1 | Tributyl Citrate | none | 0 | Try 33 | 3 |
| TBC-2 | Tributyl Citrate | Cabot LM-130 Fumed SiO2 | 5 | Try 33 | 3 |
| TBC-3 | Tributyl Citrate | Cabot LM-130 Fumed SiO2 | 5 | Try 33 | 5 |
| TBC-4 | Tributyl Citrate | Cabot LM-130 Fumed SiO2 | 5 | Try 33 | 0.05 |
| TBC-5 | Tributyl Citrate | Paraloid K-125 | 1.5 | Try 33 | 0.05 |
| TBC-6 | Tributyl Citrate | Paraloid K-125 | 1.84 | Try 33 | 0.5 |
| K-1 | Krytox 157-FSH | none | 0 | Try 33 | 0.05 |
| K-2 | Krytox 157-FSL | none | 0 | Try 33 | 1 |
| K-3 | Krytox 157-FSL | Cabot LM-130 Fumed SiO2 | 3 | Try 33 | 1 |
| K-4 | Krytox 157-FSL | Paraloid K-125 | 1 | Try 33 | 1 |
| M-1 | Mineral Oil | none | 0 | Try 33 | 0.03 |
| MO-1 | NAPA Motor Oil, SAE 30 | Arizona Road Dust | 10 | none | 0 |
| LG-1 | Lubrimatic Multi-Purpose Lithium Grease | none | | none | 0 |

TABLE 6-continued

Contaminants Used in Sensitive Equipment Decontamination Experiments

| Code | Carrier Liquid | Thickener | Thickener Conc., wt-% | Fluorescent Dye | Fluorescent Dye Conc., wt-% |
|---|---|---|---|---|---|
| LC-1 | Clover Pat Fel-Pro Water Base Lapping Compound | 50 grit SiC | | none | 0 |

(Cabosil LM-130, Cabot Corp.), and an acrylic polymer (Paraloid K-125, Rohm & Haas Corp.). Paraloid K-125 has been used to thicken military CWA. The consistency of the simulant depends on the amount of thickener used. At 1–2 wt-% thickener loading, the simulants flow like honey, while they become semi-solid gels at thickener loading greater than 5 wt-%. One key difference between colloidal silica and an acrylic polymer is that colloidal silica is not soluble in any organic solvent, but the acrylic polymer can dissolve in a more polar organic solvent. The appearance of some thickened simulants is shown in FIG. 6.

In addition to the above simulants, test pieces were also contaminated with soils that would be representative of those that could be found on fielded equipment: mineral oil, SAE 30 motor oil (NAPA) thickened with Arizona road dust (Duke Scientific Co, Palo, Alto, Calif.), multi-purpose lithium grease (Lubrimatic), and dried, 50 grit SiC water base lapping compound (Clover).

The contaminant removal tests were performed system according to the following general procedure:

1. The equipment to be processed was weighed and photographed under visible and UV light.
2. One or more tared pieces of equipment were coated with contaminant(s) or soil(s), photographed under visible and UV light, and re-weighed.
3. The test piece(s) were placed into the transfer basket of the system, which was then covered with a tight fitting screen.
4. The immersion sump of the system contained enough DECONTAMINATION FLUID to cover the part in the basket. This liquid was degassed by sonicating it for 30 minutes.
5. The transfer basket containing the items to be cleaned was lowered into the immersion sump, and statically (i.e. no liquid flow) sonicated for a finite period of time, usually 15 minutes.
6. After static sonication, the rinse pump was turned on and the liquid in the immersion bath was circulated through the activated carbon columns at a rate of 1,700 ml/minute for a finite period of time. The circulation time ranged from 15 minutes to 2 hours, depending on the purpose of the test.
7. The rate of decontamination was monitored by following the concentration of the contaminant in the decontamination liquid.
8. Steps 5 and 6 were repeated until the presence of contaminant in the circulating liquid could no longer be detected.
9. When the immersion sump liquid was free of contaminant, the transfer basket was moved from the immersion sump to the superheat sump and dried for 30 minutes to remove liquid drag out.
10. The transfer basket was removed from the system. The test pieces were removed from the basket, visually examined, photographed under visible and UV light, reweighed, and archived.

The circulation rate of 1.7 liters per minute through the activated carbon column system was based on the volume of the four primary activated carbon columns and a liquid residence time of 5 minutes in these columns. This residence time was found to result in effective removal of DEP from decontamination fluid, with an acceptable column capacity for DEP.

As the program evolved, three different methods of monitoring the rate of removal of contaminant from the articles being processed.

It was observed that it was possible to visually detect the presence very low levels of fluorescent dye dissolved in decontamination fluid when the immersion sump was illuminated with an ultraviolet light source (Black-Ray® Model B 100AP Long Wave Ultraviolet Lamp, UVP, Upland, Calif.). Initially the color intensity of the liquid in the sump was used to monitor the process. This method was not as sensitive as desired when trying to determine the end point of the removal of the contaminant from the liquid being circulated or breakthrough of the activated carbon columns.

More quantitative measurements were obtained by periodically sampling the liquid in the ultrasonic bath, and the liquid exiting the activated columns, and measuring the concentration of the contaminant in the liquid by UV adsorption and by fluorescence.

UV measurements were performed on a Shimadzu 1201 spectrophotometer at a wavelength of 273 nm, with a 10-mm path quartz cell. This method could detect Try-33 at a concentration level of the order of 0.1 ppm. This corresponds to contaminant concentrations of the order of 2 ppm (5% Try 33) to 200 ppm (0.05% Try 33).

The bulk of the fluorescence measurements were performed with a TD-700 Laboratory Fluorometer manufactured by Turner Designs, Inc., Sunnyvale, Calif. In these tests, the liquid sample in a 10-mm path quartz cell was excited by light filtered at 436 nm. The light emitted by sample, which is a function of the concentration of fluorescent material present, was filtered at 520 nm. With this single beam instrument, the detection limit for Try-33 was estimated to be of the order of 100 ppt. Since a Try-33 concentration of Try-33 of 0.5 wt-% was used in these experiments, the detection limit of the doped simulant was therefore of the order of 2 ppb. Selected samples of liquid leaving the activated carbon columns during these tests were subsequently analyzed with a Spex Fluoromax 3 spectrofluorometer. For Try 33 in HFE-710, the maximum excitation and emission wavelengths were 400 and 474 nm, respectively. At these wavelengths, the lowest Try 33 concentration that could be detected is 10–5 mg/liter, which corresponds to a concentration of 10 ppt. The concentration of Try-33 in the activated carbon column effluent liquids analyzed was found to be below the detection limit.

Table 8 lists the sensitive equipment decontamination experiments that were carried out in the system during the course of the program. The combination of equipment processed, contaminants used, and monitoring method(s) examined are listed in this table.

The results of the various cleaning results are summarized in FIG. 12. This table records the weights of the items listed in Table 8, before and after contamination, as well as the post-cleaning weight and visual appearance of these items.

Except for the runs where there was visible attack of the substrate by the simulant (as in run 1), there was an increase of less than a 0.1 gram in the weight of the object after contamination and cleaning and the original (i.e. before contamination) weight of this object. In some cases, there was a weight loss of the order of 0.1 gram (as in the calculator in run 6 and the pistol in run 9). This was attributed to the removal of other soils that were previously present on these test items.

If the ratio of (weight change/contaminant weight) is used as a cleaning criterion, this value is less than 10%, except for run 1 (for the reasons cited above), and for runs 13 to 17. For these last five runs, the relatively high values of this ratio is attributable to weighing errors. The weightings were performed on a balance that had an accuracy of ±0.02 grams, which would account for most of the observed weight differences.

TABLE 8

List of Sensitive Equipment Decontamination Experiments Performed

| Experiment No. | Date | Sensitive Equipment Processed | Contaminant(s) | Monitoring Method |
|---|---|---|---|---|
| 1 | Oct. 21, 1999 | Multimeter | DEP-1 | Visual |
| 2 | Oct. 21, 1999 | 2 Microscope Slides & 2 circuit boards | TCB-2 | Visual, UV |
| 3 | Nov. 2, 1999 | 2 Multimeters | TBC-3 | Visual, UV |
| 4 | Nov. 8, 1999 | Multimeter | K-1 | |
| 5 | Nov. 16, 1999 | Multimeter | TBC-4 | Visual, UV |
| 6 | Nov. 18, 1999 | GPS Receiver & Radio Shack Calculator | K-1 & M-1 | Visual, UV |
| 7 | Nov. 30, 1999 | Multimeter & Night Vision Goggles | K-1 & M-1 | Visual |
| 8 | Dec. 8, 1999 | Multimeter & Circuit Board | TBC-5 | Visual, UV |
| 9 | Dec. 9, 1999 | Walter PP Pistol | TBC-5 & K-1 | Visual |
| 10A–10E | Dec. 12, 1999 | Multimeter & Pipe Nipple (10 D only) | K-1 | Visual |
| 11 | Dec. 16, 1999 | Multimeter | MO-1 & LG-1 & LC-1 & K-1 | Visual |
| 12 | Dec. 19, 1999 | 2 Magnet Assemblies & 2 Brass nipples | K-1 | Visual |
| 13 | Jan. 18, 2000 | Multimeter - Face Down | K-2 | Fluorescence |
| 14 | Jan. 19, 2000 | Multimeter - Face Down | K-3 | Fluorescence |
| 15 | Jan. 20, 2000 | Multimeter - Face Down | K-4 | Fluorescence |
| 16 | Jan. 21, 2000 | Multimeter - Face Up | K-4 | Fluorescence |
| 17 | Jan. 22, 2000 | Multimeter - Face Down | TBC-6 | Fluorescence |

While not a quantitative measurement, visual examination under ultraviolet illumination was considered to be the most sensitive and accurate means available to ESI of assessing whether traces of fluorescent contamination remained on the processed objects. Fluroescent contamination was observed only for run 1, and runs 3 and 5, where there was no noticeable weight increase.

All the functional test items listed in FIG. 12 were operating properly after having been subjected to the decontamination process, including the multi-meter from run 10, which had been processed five times, and the ones from runs 1, 3 and 5, for which surface damage or deposits were noted, Establishing the decontamination kinetics included:

a. Measuring the rate of removal of a contaminant from a test piece by examining the concentration of this contaminant in the ultrasonic bath as a function of time during a static ultrasonic rinse, i.e. without circulating the liquid through the activated carbon bed, and b. Measuring the rate of removal of the contaminant from the process liquid as it circulates through the activated carbon columns.

Figure 14:
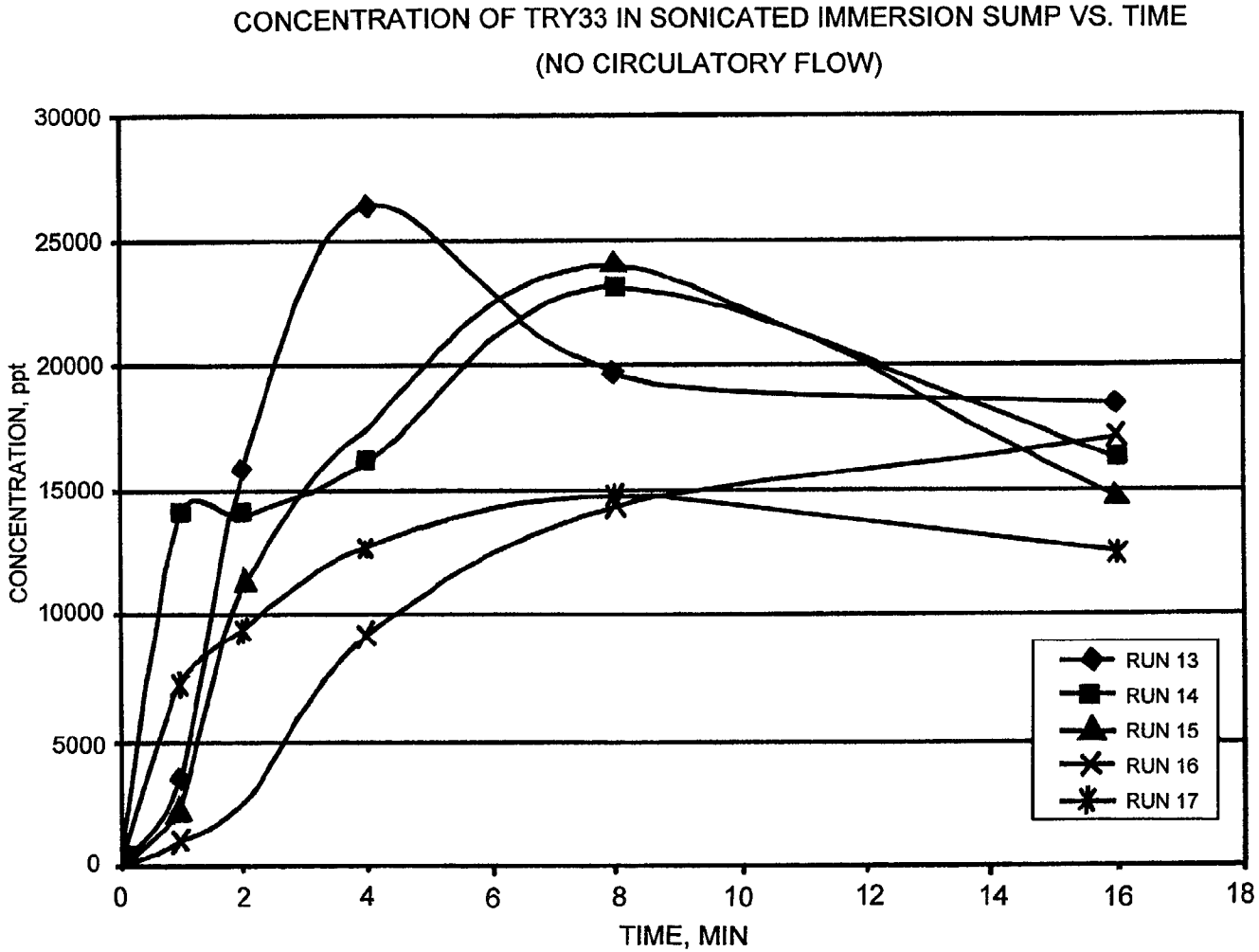
FIG. 14 is another graph showing the concentration of an indicator in an ultrasonic bath.
Figure 15:
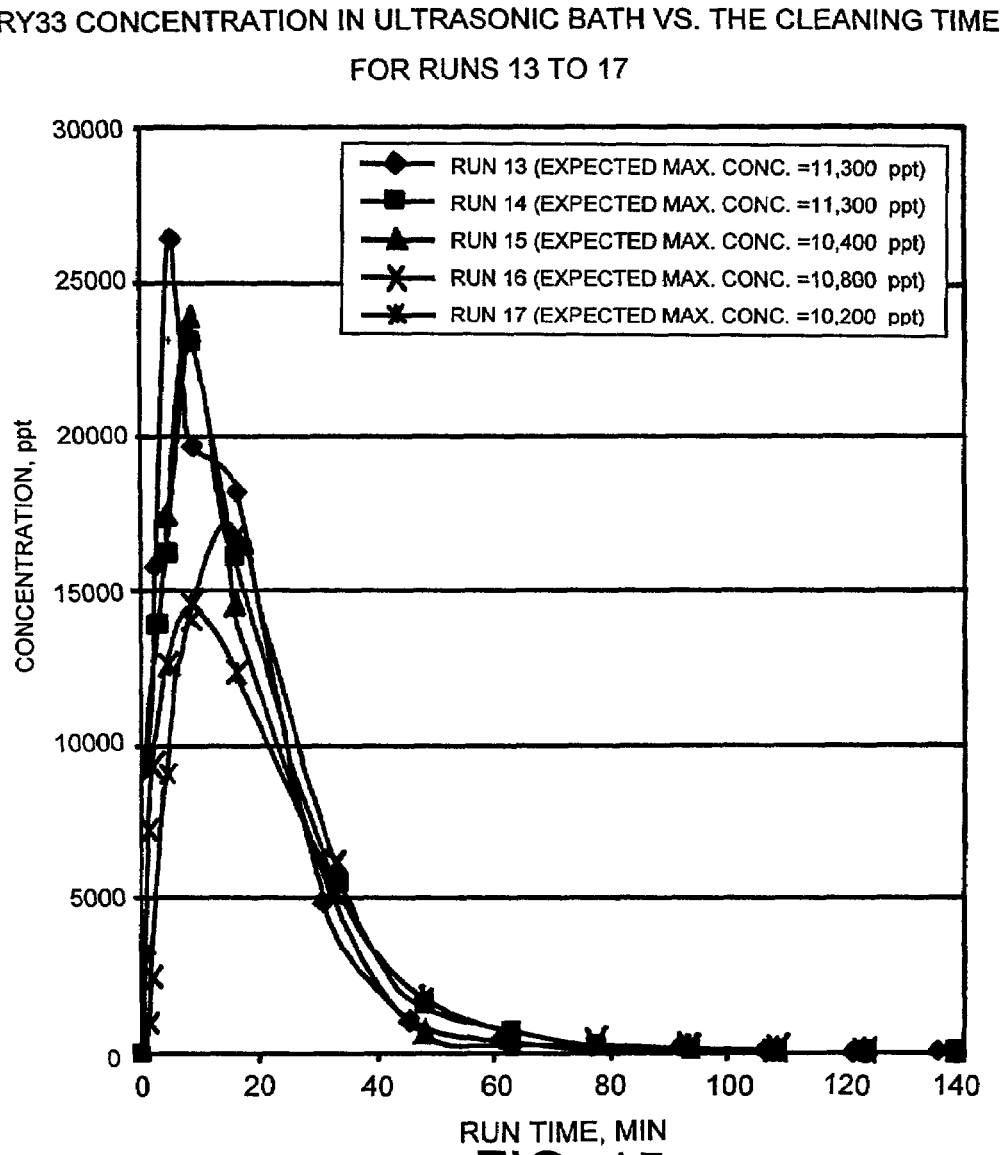
FIG. 15 is another graph showing the concentration of an indicator in an ultrasonic bath.

These data were obtained by UV adsorption for runs 2 and 3, and by fluorescence measurements for runs 13–17. The measured contaminant concentration in the immersion sump liquid as a function of run time is presented in FIG. 13 for runs 2 and 3, and in FIGS. 14 and 15 for runs 13–17. The data for the first 16 minutes of runs 13-17 are presented in FIG. 14. In these plots, concentration initially rises, ultimately reaching a plateau, and then decreases with time once the circulation pump is turned on.

Initial Rate of Contaminant Removal: Examination of FIGS. 13 and 14 indicates that it takes about 15 to 20 minutes for the contaminant concentration in the immersion to level out without liquid circulation, whether the concentration in the bath is of the order of 10 ppm or 10 ppb. At the lower concentration (FIG. 14), the initial rate of solution of the contaminant into the process liquid appears to be a function of both contaminant consistency and location of the contaminated sample in the bath.

Comparing the data for the test pieces placed face down in the bath, the rate of dissolution was lower for the thickened contaminants than for the neat contaminant, with the 1.84% Paraloid K125 thickened material dissolving the most slowly.

Placement is also important. This was noted by comparing Run 15 and 16. The rate of removal was lower for Run 16, where the contaminated area of the sample was away from the ultrasonic transducers, than for Run 15, where the contaminated area faced the transducers.

It is also to be noted that the level of TRY-33 in the bath was about the same after 16 minutes of immersion indicating that most (or all) of the contaminant in each case had dissolved and that the concentration of the contaminant in the bath was fairly uniform. High prior values are believed to be due to poor mixing in the bath.

The values of TRY-33 concentration in the bath after 16 minutes are, in each case, about 50% higher than the expected value of 10 ppb (or $10^4$ ppt). This is not a bad material balance closure given the uncertainties of mixing in the bath and experimental errors in the preparation of the contaminant solutions and the preparation of the test pieces, and the possible absorption of the contaminant into the test piece.

Figure 16:
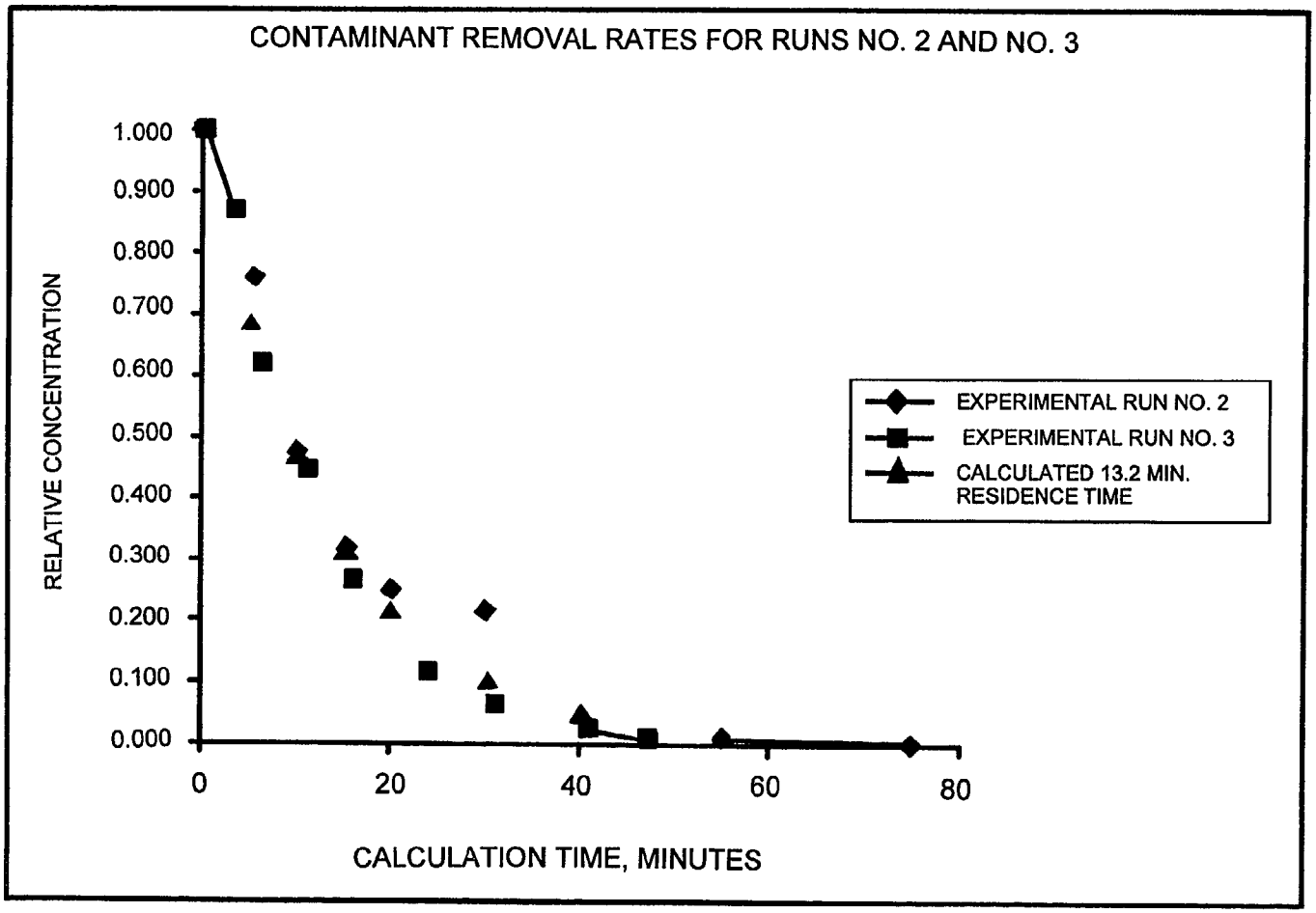
FIG. 16, is a graph showing the removal of contaminant from the decontamination fluid over time.
Figure 17:
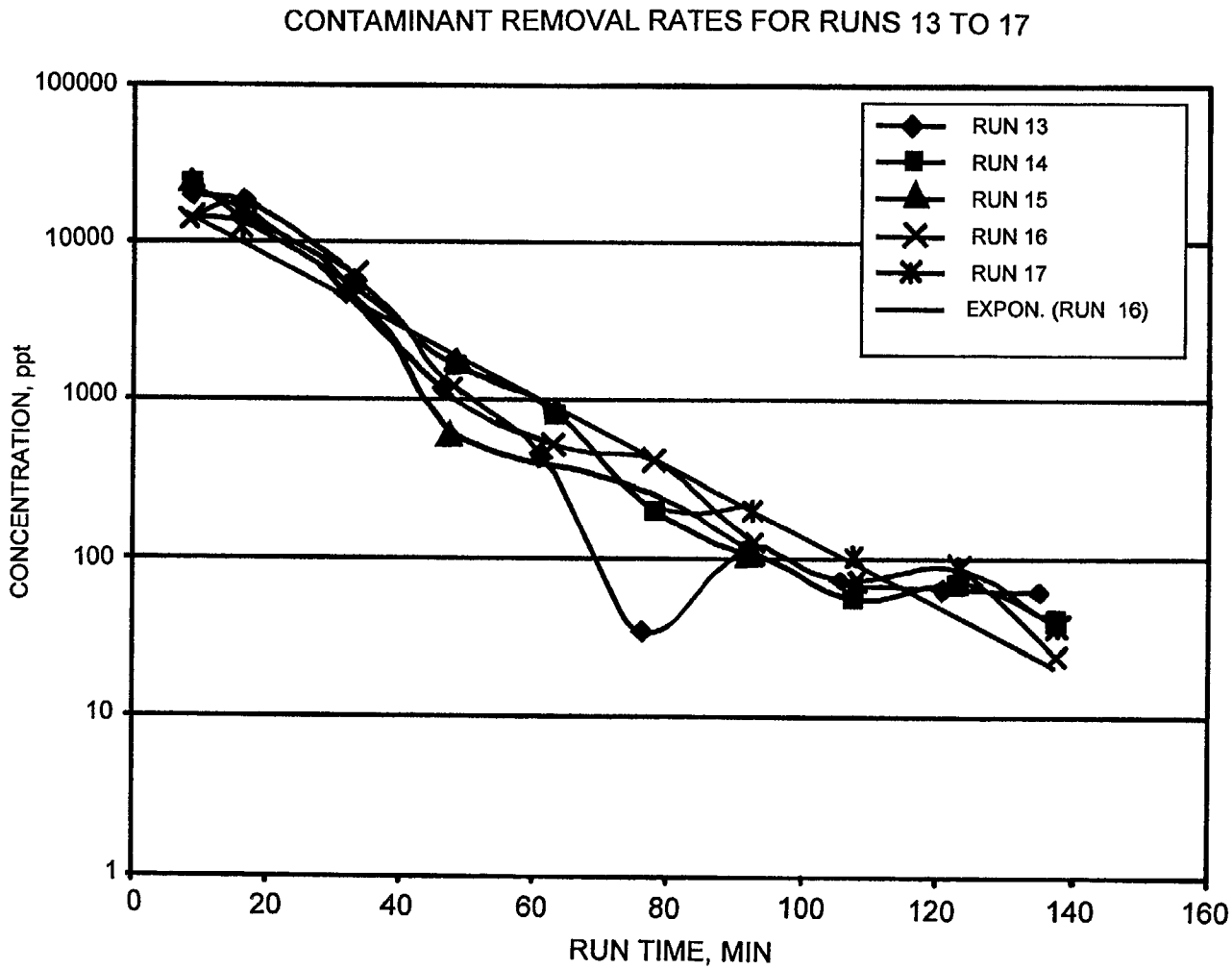
FIG. 17 is another graph showing the removal of contaminant from the decontamination fluid over time.

For run 2, a plateau value of 27 ppm was reached vs. an expected concentration of 43 ppm. For run 3, a plateau value of 87 ppm was reached vs. an expected value of 110 ppm. In both cases, the concentrations ramped up more smoothly than for the lower concentration runs presented in FIG. 14. Because of the higher concentration levels, there is more diffusional mixing. The differences between the expected and measured values are in part due to experimental error, and in part due to absorption of the contaminant into the test piece Contaminant Removal from Circulating Liquid As indicated by the semi-log plots presented in FIGS. 16 (runs 2 and 3) and 17 (runs 13 to 17)), the contaminant concentration in the immersion sump liquid decreases exponentially with time. As indicated in these figures, the contaminant concentration drops about two to three orders of magnitude to the detection limits of the instruments in a period of about 1 to 2 hours. No traces of contaminant were detected in the return line from the activated carbon beds.

The drop in contaminant concentration with time is exponential as would be expected from first order kinetics.

Figure 18:
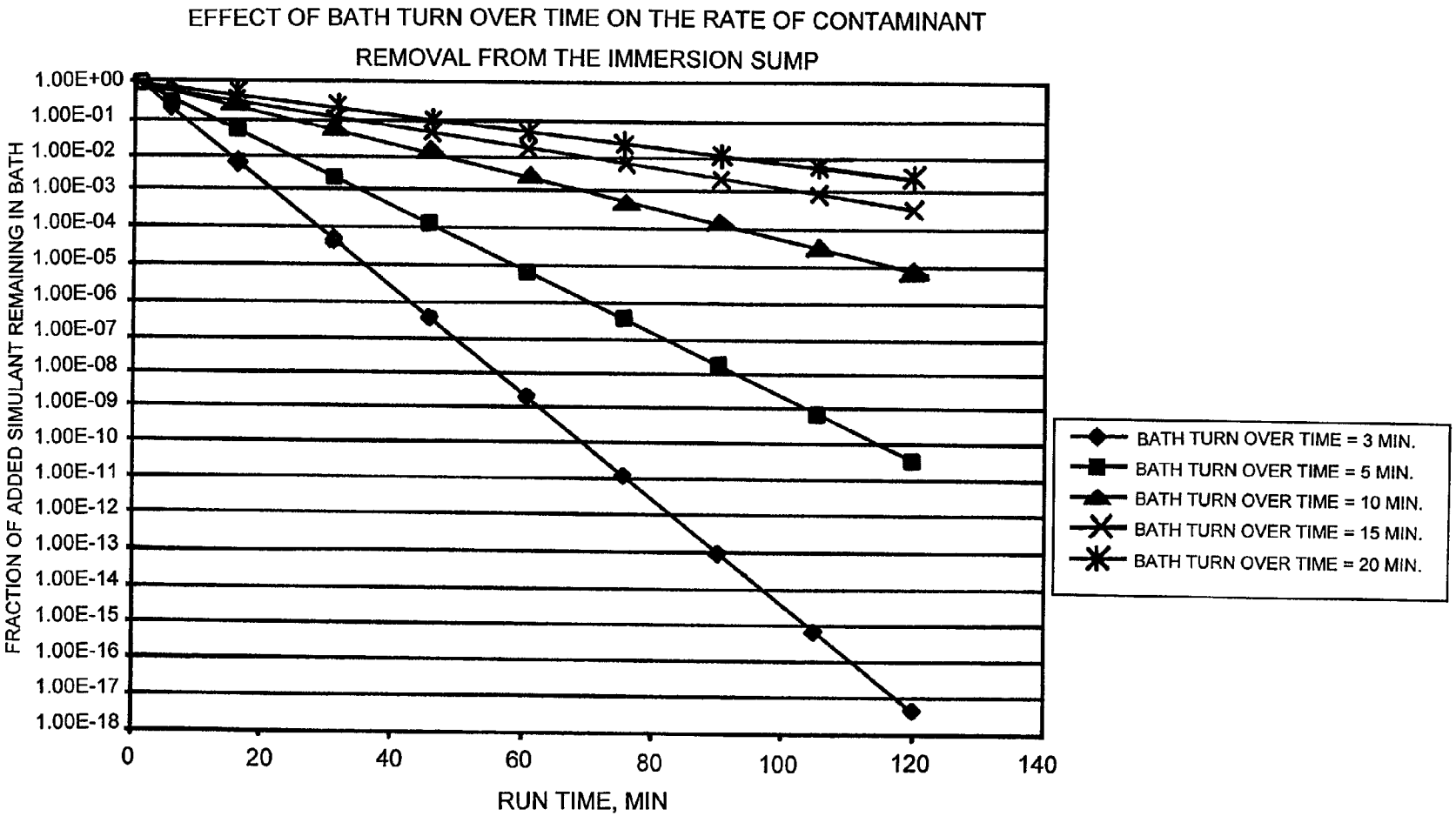
FIG. 18 is a graph showing the effect of turnover time on rate of adsorption of contaminant from the decontamination fluid.

The effect of turnover time on residual contaminant concentration in the bath, assuming first order kinetics, is presented in FIG. 18. The data for the present experiments closely follow the 15-minute line in the figure. The amount of time needed to reduce the level of contaminant in the bath is significantly reduced as the bath turnover time is reduced. If the bath turnover time were reduced to 5-minute (which would require the flow rate and the volume of the activated carbon beds to be quadrupled in size), a three log reduction in contaminant concentration would be achieved in less than 30 minutes.

The cleaning results summarized in FIG. 12 also indicate that contaminants that are not soluble in decontamination fluid may be removed from a surface by ultrasonic agitation in this solvent. In this case, the contaminant is physically detached from the surface being cleaned, and then suspended in the sonicated liquid. The suspended material is subsequently removed from the liquid by filtering it through a microporous filter.

Of the various contaminants listed in Table 6-1, only DEP, TBC, and Krytox are soluble in decontamination fluid. All the other materials listed are not soluble in decontamination fluid, including thickeners such as LM-130 fumed silica and Paraloid K-125 acrylic polymer, mineral oil, SAE 30 mineral oil, lithium grease, and silicon carbide grit (water base lapping compound). Neither are any biological agents or most components of radioactive fallout.

Removal of insoluble contaminants requires that sufficient mechanical shear force be applied to the surface of the part being cleaned by the cleaning medium to overcome the force of adhesion between the contaminant and the substrate. With the exception of runs 1, 3, 5 and 12, this was accomplished for the runs listed in FIG. 12. Run 1 is considered an anomaly because the simulant attacked the plastic housing of the multimeter used as a test object.

In runs 3 and 5, even though gravimetric results indicated effective cleaning, deposits of colloidal silica used to thicken the simulant were found on the test piece after processing. It was noted that, in run 3, somewhat more residual silica visibly remained on multimeter 2, where the contaminated face was placed up in the immersion sump (away from the ultrasonic transducers), than on multimeter 1, where the contaminated face was placed down in the immersion sump (facing the ultrasonic transducers). As further discussed below, using higher frequency or higher power ultrasonics, or a spray wand, would remove this residue.

In run 12, where a grab bag of contaminants was used, as discussed in Appendix I, sonication in decontamination fluid at 40 kHz did not result in complete contaminant removal. These were removed by then spraying with decontamination fluid, and subsequent sonication in an ultrasonic bath with a higher power density with a solution of Krytox oleate.

The force transmitted to a surface is a function of the properties of the ultrasonic bath, especially power density and frequency. The advent of ultrasonic baths that can be operated efficiently at more than one frequency is a significant advance in that this allows a much broader range of soils to be effectively removed. In particular, increasing the frequency of an ultrasonic bath results in a reduction of the thickness of the static liquid boundary layer between the agitated liquid and the surface of the object being cleaned. This thinning of the boundary layer results in the exposure of smaller particles to the shearing effect of ultrasonic agitation, and thus their removal.

Initially, the performance of a 132 kHz ultrasonic bath was compared to that of a 40 kHz ultrasonic bath, in terms of the removal of particles of different sizes from a glass substrate in decontamination fluid, and in solutions of a fluorinated surfactant, Krytox 157FS(L), in decontamination fluid. Soil detachment is also facilitated or enhanced if the cleaning liquid contains additives that can adsorb on the soils to be removed and on the substrates to be cleaned. ESI has developed processes that utilize solutions of fluorinated surfactants in highly fluorinated liquids to obtain enhanced particle removal. These tests indicated that increasing the ultrasonic bath frequency from 40 kHz to 132 kHz greatly enhances the removal of micron sized particles from a substrate.

Similar particle removal tests were subsequently performed with a multifrequency (40 kHz, 72 kHz, 104 kHz and 172 kHz) ultrasonic bath, with similar results. Using high frequency ultrasonics in combination with solutions of Krytox 157FS(L) in decontamination fluid as the cleaning medium resulted in the detachment of 0.5 μm particles. This is an order of magnitude smaller in diameter (0.5 μm vs. 5 μm) than is achieved by sonication in decontamination fluid at 40 kHz. This is of significance with regards to the removal of biological agents, as is discussed in a subsequent chapter.

The effect of frequency on the removal of both neat and Paraloid K-125 thickened TBC, from exposed and protected surfaces, by decontamination fluid was also examined. Both neat and thickened TBC were easily removed from exposed surfaces by sonication in decontamination fluid, at all frequencies tested. With protected surfaces (the screen in a magnet-screen-magnet assembly), the contaminant without thickener is removed, leaving a residue of thickener on the protected surface.

BIOLOGICAL DECONTAMINATION

The present system also allows for the decontamination of biological contaminants from sensitive equipment. The decontamination liquid for decontamination or deactivation of biological warfare agents, such as proteins and microorganisms including pathogenic bacteria, spores, viruses (collectively "Biological Contaminants") include the HFCs discussed above, and solutions of HFC with a surfactant. The decontamination liquid thus preferably meet requirements for the decontamination liquid used in CWA removal as well as being able to aid in deactivating or decontaminating biological decontamination.

Surfactants soluble in the HFCs or decontamination liquids were selected. Preferably they contain at least ten, 14 to 100, carbon atoms and one or more polar groups capable of interacting with a solid surface. These polar groups include species with active hydrogen atoms, such as carboxylic acids, sulfonic acids, and alcohols. The surfactant preferably has a higher boiling point than the HFC liquid with which it is used. Surfactants may have perfluorinated non-polar groups, may advantageously have a low HLB (hydrophile to lipophile balance), preferably less than about 9. Surfactants that have been shown to be useful include Oleic Acid, Oleyl Alcohol, Krytox Alcohol, Krytox 157, LAN-3, Rhodasurf, and Rhodasurf LA-3, Fomblin Z Diacid Fluid, and Perfluorodecanoic acid.

It is important that the surfactant can be easily removed from the surface to be cleaned, as by rinsing with the HFC liquid. Otherwise, the cleaning process will merely result in the substitution of one contaminant for another. Other surfactants that may detach particles from the surface are not suitable, because they are not so easily removed as the class of surfactants described herein.

Even the addition of a trace amount of surfactant to the HFC liquid results in significant removal or deactivation of the biological contaminants. Thus, concentrating ranging from as low as 0.01 weight percent, up to the solubility limit, can be used. The preferred concentration of surfactant in the HFC is in a range of about 0.5 to 10 weight percent.

The relatively high molecular weight of the surfactant is desirable in order to make the surfactant highly miscible with the HFC and also to enhance the separation of the particles from the surface of the equipment to be cleaned.

The following are examples of commercially available preferred surfactant materials:

Krytox 157FS (L), the trade designation of perfluoroalkylpolyether terminated by a carboxylic acid end group, which has an average molecular weight of about 2,000, marketed by E.I. DuPont de Nemours & Co., Inc. ("DuPont").

Krytox 157FS (H), the trade designation of perfluoroalkylpolyether terminated by a carboxylic acid end group, which has an average molecular weight of about 6,000, marketed by E.I. DuPont de Nemours & Co., Inc.

Fomblin Z Diacid Fluid, the trade designation of a strait chain perfluorinated polyether polymer terminated by two carboxylic acid groups with an approximate molecular weight of 2,000, marketed by Montedison USA, Inc.

Perfluorodecanoic acid, represented by the chemical formula $C_9F_{19}COOH$ with a molecular weight of 514, as marketed by SCM Specialty Chemicals.

Krytox alcohol, the trade designation of perfluoroalkylpolyether terminated with an alcohol end group, with an average molecular weight between about 2000 to 6000, marketed by DuPont.

Rhodasurf LAN-3 (Detergent range alcohol ethoxylate, $C_{12-14}H_{25-29}O(—CH_2CH_2O—)_{3-9}H$)

Rhodasurf LA-3 (Detergent range alcohol ethoxylate, $CH_3(CH_2)_{11-14}O(—CH_2CH_2O—)_{3-9}H$)

Biological decontamination can take place in the present system 100 after the Chem Decon Filter Mode and the Chem Decon Activation Mode have taken place. Alternatively, it may take place by itself.

It has been found that biological contaminants are effectively removed or inactivated by immersion and sonication in a decontamination fluid such as HFE-7100 or solutions of a fluorinated surfactant, such as Krytox 157FS, in decontamination fluid.

Vegetative cells are killed by sonication in decontamination fluid.

Sonication processing in decontamination fluid with 4% to 6% Krytox 157FS can result in the sterilization of slides initially contaminated with approximately 100 spores(i.e. $>10^5$ spores/$m^{2)}$)

Processing in these solutions also sterilizes equipment that had been initially contaminated with $10^4$ bacteriophage particles.

Immersion in decontamination fluid, with or without surfactant, denatures proteins.

The physical removal of biological species from a contaminated surface by sonication in decontamination fluid is enhanced by the presence of >1% Krytox 157FS in the decontamination fluid, and by the use of higher frequency ultrasonic (>100 kHz) agitation.

As discussed above, the inactivation of biological agents is greatly enhanced by the use of HFC surfactant solutions. Biological decontamination therefore entails first contacting the equipment with a HFC/surfactant solution and then rinsing the surfactant residues from the treated parts with a pure HFC solution.

In one embodiment, the equipment is first contacted with the HFC/surfactant solution by operating the system 100 in a Bio Decon Wash Mode by placing the equipment to be decontaminated in the immersion sump 204, as discussed above. The process flow diagram for the Bio Decon Wash Mode is shown in FIG. 10. The immersion sump 204 is filled with a decontamination liquid preferably HFE-7100-Krytox 157FS surfactant solution and sonicated using the transducer 205. The HFC/surfactant solution is drawn from the boil sump 202 by pump J-1. It passes through filters F-1 and F-2, to remove suspended biological material, before entering the bottom of the immersion sump 204. This returning liquid displaces the liquid already in the sump 204, which overflows into the boil sump 202, closing the circulation loop. In this mode, the activated carbon module 300 is by-passed to prevent stripping of the surfactant from the solution. Condensed vapors are returned to the boil sump 202.

The system 100 is then operated in a Bio Decon Rinse Mode to remove residual surfactant from parts after the Bio Decon Wash Mode by rinsing the parts with pure HFC solution. The process flow diagram for this mode is shown in FIG. 11. Surfactant solution in the immersion sump 204 is drained into the boil sump 202 by the pump J-2 taking surfactant-containing fluid through heat exchangers C-2, ball valve BV-5, filters F-3 and F-4, check valve CV-2 and ball valve BV-3 (there is no bolding of the tubing T to show the fluid flow of this one-time operation). The immersion sump 204 is then refilled with condensed surfactant free HFE-7100 vapor passing from the boil sump 202 through the water separator 270 and ball value BV-9. Once the sump 204 is full, liquid then overflows back into the boil sump 202, closing the circulation loop. The ultrasonic transducer 205 is activated when the sump 204 is full to enhance the rate of dissolution of residual surfactant into the circulating HFC liquid.

After a given period of time necessary to clean the equipment of surfactant, the basket containing the equipment is manually removed from the immersion sump 204 and placed in the drying sump 206 where any residual decontamination liquid is evaporated.

Sonication combined with some of the hydrofluorocarbon liquids tested is an effective means of reducing levels of bacterial contamination on functional circuit boards. The number and type of biological threat simulants examined was expanded to include microorganisms (bacteria, spores, and viruses), and proteins. The chemistries that were examined in these biological studies included using hydrofluorocarbons that met the constraints imposed by materials compatibility and ability to remove chemical warfare agents.

A Krytox-157FS/HFE-7100 solution used to achieve biological decontamination is recovered and recycled by passing it through a filter train that removes the suspended biological materials. Ideally, in operation, any contaminants that are soluble in decontamination fluid will have been removed by pre-rinsing the contaminated items with surfactant-free decontamination fluid. Contaminants that are soluble in decontamination fluid are removed before the contaminated parts come into contact with the Krytox-157FS/HFE-7100 solution. This eliminates the need for contacting this solution with activated carbon, which would also strip the Krytox 157FS from the solution.

Microbiological contaminants may be removed by passing the process liquid through an appropriate membrane filter. One filter that has been used effectively is a 20" long 0.2 μm rated Pall Ultipore™ $N_{66}$NF pharmaceutical grade cartridge filter. The Ultipore™ $N_{66}$NF is a sterilizing grade filter that has long been used in the pharmaceutical industry for the production of sterile products and intermediates. Microbial-retentive filters are given a micron grade rating based on their microbial titer reduction ($T_R$) capabilities, which are determined by challenging the filters with an appropriate microorganism under stringent test conditions. $T_R$ is defined as the ratio of the number of influent test organisms to the number of effluent organisms. Ultipore™ $N_{66}$NF filters were found to have a $T_R>10^{12}$ when challenged with *Brevundimonas* (*Pseudomonas*) *diminuta* at more than $10^8/cm^2$. Of course, filters from other manufacturers may be used, and the number and size of filter cartridges may be varied to meet the requirements of any particular installation.

Preferably, the filter will be housed in a standard commercially available stainless steel housing that will be mounted in the cleaning cabinet. This filter assembly is fitted with quick disconnect fittings that incorporate dual shut off valves to allow it to be easily removed and replaced.

The efficacy of removing microbiological contaminants from substrates by sonication in the presence of hydrofluorocarbons was investigated experimentally. In these experiments, the contaminated objects were glass microscope slides on which aqueous suspensions containing known amounts of microorganism were deposited, and then air-dried. The slides were then processed in different hydrofluorocarbon liquids under varying conditions in efforts to decontaminate the slides. After processing, the slides were cultured to reveal any remaining viable organisms. Efforts were also made to detect the presence of viable microorganisms in the processing liquid (i.e., organisms that had been removed from the slide during processing). Spent processing liquid was passed through filters capable of trapping microorganisms, and then the filter was cultured on a solid agar medium to detect the presence of viable microorganisms.

The microorganisms studied were vegetative cells of *Bacillus thuringiensis,* spores of *Bacillus subtilis,* and the bacterial virus ΦX174.

Numerous variables in the processing conditions were examined during the course of the study. Most of this work was done using spores as the microbial contaminant. The variables examined included sonication at either 40 or 132 kHz, processing in a glass versus a stainless steel test cell, using different processing liquids (HFE 7100, HFE 7200, Vertrel XF) with or without varying concentrations of fluorinated surfactants (Krytox 157 FSL or FSH, and Krytox alcohol), both in batch and continuous flow modes.

In the batch mode, contaminated slides were processed in beakers or jars for a given time period, and then the processing liquid was poured off and replaced before a second cycle of sonication was initiated. Slides were run through a variable number of processing cycles using this method, and the liquid used for processing was then pooled and filtered in order to detect viable microorganisms that had been removed from the slides.

Continuous mode processing was performed in the MVM Cadet. The Cadet instrument circulates liquid through a test cell that is immersed in a sonicating water bath. Slides are placed inside the test cell for processing. Liquid leaving the test cell is passed through a filter capable of trapping any microorganisms removed from the slide. Thus fresh liquid, devoid of microbial contaminants is circulated back to the cell. Sonication could be performed with constant flow of liquid through the test cell. In other studies periods of sonication carried out without flow of liquid through the test cell were interspersed with periods of liquid flow through the cell to remove any microorganisms that had been released from the slides being processed.

Sonication at 45° C. appeared to have an adverse effect on the viability of the vegetative cells studied, but the spores and phage employed in our studies seemed fairly resistant to these treatments. We were able to document the physical removal of both vegetative cells and spores by the decontamination process, since these organisms could be trapped and detected on filters through which spent processing liquids were passed. Processing in HFE 7100 containing 0.5% to 1.0% Krytox 157 FSL or Krytox alcohol rendered slides initially loaded with up to approximately $1\times10^3$ vegetative cells sterile. For effective removal of spores, higher concentrations of surfactant (4.0 to 6.0% Krytox 157 FSL) were required. Processing in HFE 7100 containing higher surfactant concentrations accomplished sterilization of about 75% of slides initially contaminated with approximately $10^2$ spores (about $10^5$ spores/$m^2$)

The decontamination of slides initially loaded with bacteriophage particles was observed. The assay system used could not detect viable phage on processed slides that had originally been loaded with up to $10^4$ phage particles (about $10^7$ particles/$m^2$). The most efficient processing liquids tested were HFE 7100 with either 2.0 or 5.0% Krytox 157 FSL. Because of limitations in the experimental system used, the recovery of phage particles in the hydrofluorocarbons used to process slides contaminated with phage was not successfully demonstrated.

Figure 8:
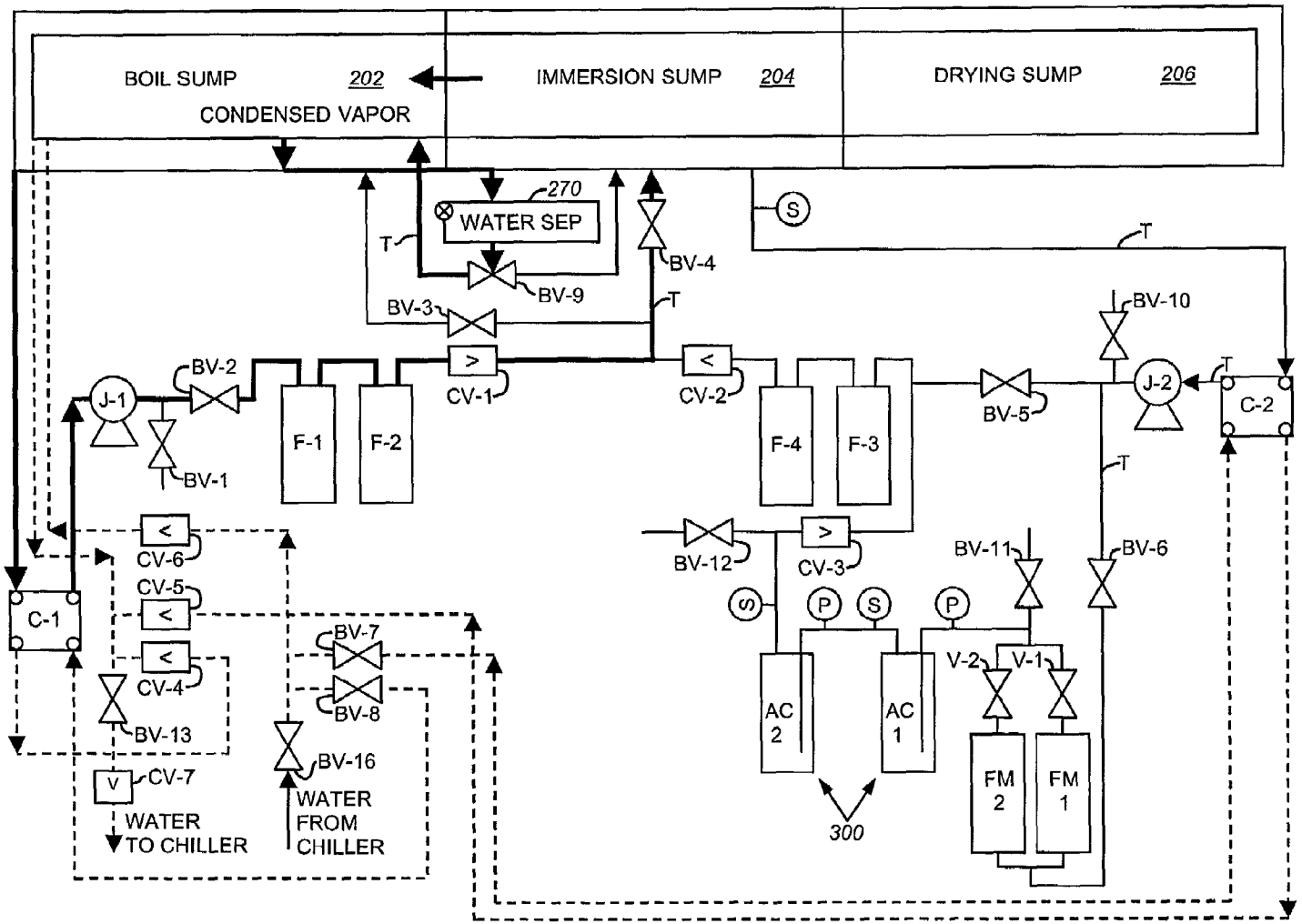
FIG. 8 is a process flow diagram showing one embodiment of a decontamination system in the Bio Decontamination Wash mode.
Figure 9:
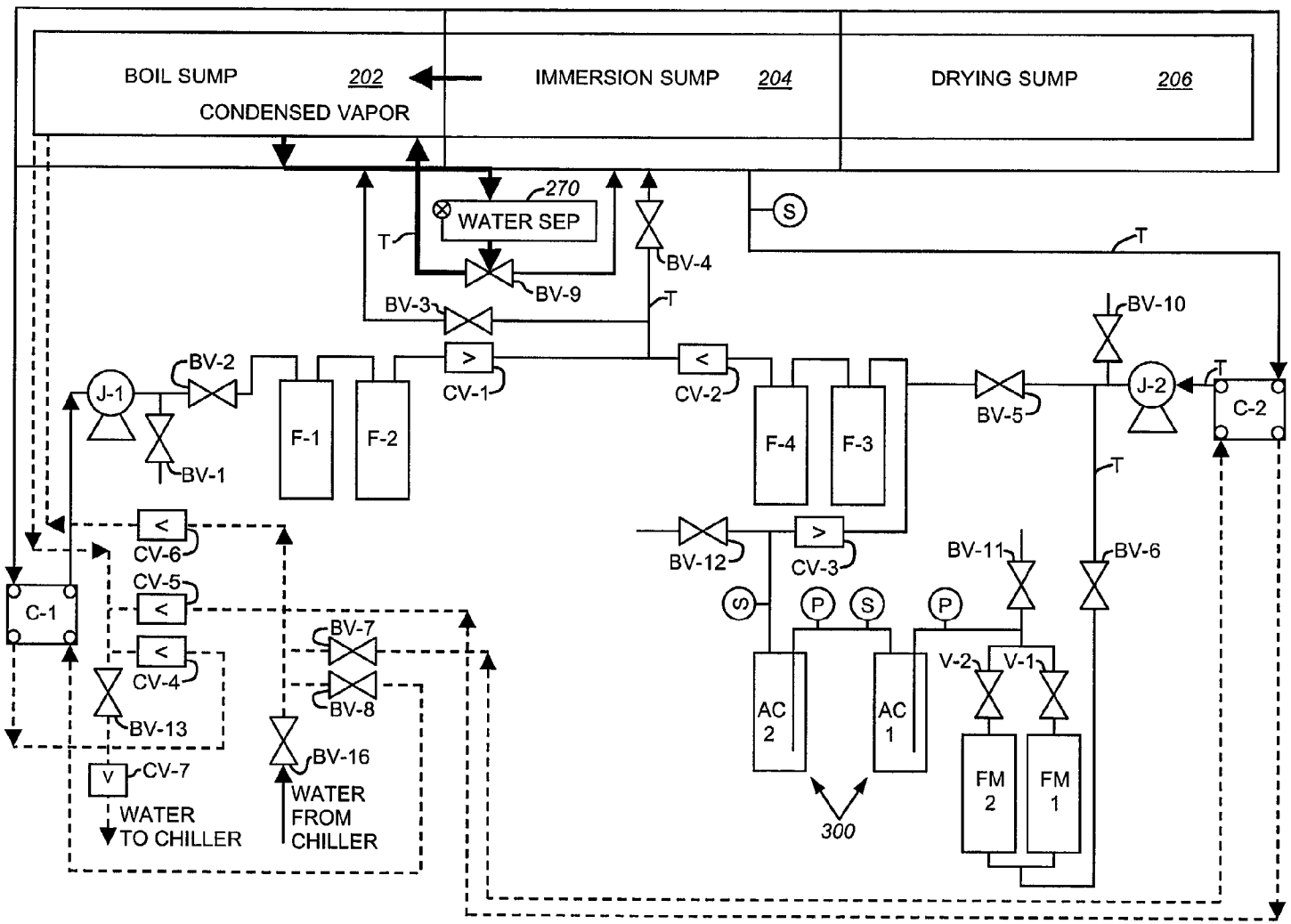
FIG. 9 is a process flow diagram showing one embodiment of a decontamination system in the Bio Decontamination Rinse mode.

Some tests were also performed to assess the efficacy of the decontamination process in terms of removing casual microbial contamination acquired from the environment. Circuit boards that had been exposed to the ambient atmosphere in a clinical microbiology laboratory were used as the contaminated objects in these experiments. As shown in FIG. 8-1, control boards that were cultured after exposure to routine environmental contamination evidenced growth of bacterial and fungal species, while circuit boards that were processed in HFE 7100 containing 6.0% Krytox 157 FSL were rendered sterile.

The decontamination process examined in these studies appears to be a promising technique for decontamination of items that would be damaged when exposed to traditional methods of sterilization.

These studies focused on the denaturization and the removal of proteins from the surface of circuit boards, by HFE-7100, and solutions of Krytox 157 FSL in HFE-7100. The model board used was a 1.5 in by 1.5 in printed circuit board consisting of three resistors and a logic gate. Mouse immunoglobulin (IgG) was used as a model protein.

Because the activity of a protein depends on its structure or conformation, the fact that the treatment may denature the protein would make it no longer biologically active. As denaturation is usually the result of a conformational change, it was studied using polarimetry as a means of detection. The results showed that HFE changes the conformation of the proteins, indicating denaturization.

After a known concentration of IgG was placed on the board and allowed to dry, the board was treated via an ultrasonic bath in a solution of HFE with or without Krytox. This report describes the work done to improve the efficiency of IgG removal through two main approaches and as a function of 1) the sonication time in the HFE-surfactant mixture, 2) temperature, 3) IgG concentration, and 4) Krytox concentration.

A "direct" approach was followed to measure radiolabeled IgG directly on the board. The radioactivity emitted by the radiolabeled protein was counted (as count per minute or CPM), before and after treatment. By correlating the measurement of gamma emission via a NaI Counter before and after treatment, the amount of IgG removed could be measured. Thus, the efficiency of the removal was well determined.

The best treatment lead to 87.6% removal in average with a maximum of 96.3%. It included a pretreatment for humidifying the contaminated circuit board by either spraying it with water or exposing it to water vapor, followed by sonication in a solution of HFE-7100+5% Krytox, for 90 minutes at 45° C. Protein removal levels of 84.4%, with a maximum of 92%, were achieved. Without the pretreatment, the percentage of removal, using the same parameters (5% Krytox, sonicated for 90 minutes at 45° C.), was 71.9% with a maximum of 86.2%. Lower sonication intensities resulted in lower removal (40.9%).

An examination of the removal of polystyrene latex (PSL) spheres ranging from 0.2 μm to 5 μm in diameter from glass slides by sonication in HFE-7100 and in solutions of Krytox 157FS surfactant in HFE-7100 was performed. The parameters examined included particle size, surfactant concentration (from 0 to 3 wt-%), the type of ultrasonic bath, and the applied ultrasonic frequency.

The ultrasonic baths used were a Crest 40 kHz three-gallon bath, a Crest 132 kHz five-gallon bath, and a CAE Ultrasonics multiSONIK five-gallon bath (which could operate at 40 kHz, 72 kHz, 104, kHz and 170 kHz). The slides were sonicated at full power (resulting in a power density of about 100 watts/gallon) for two 5-minute sonication cycles in the Crest baths, but only for two 3-minute sonication cycles in the CAE bath.

Particle removal effectiveness was a function of particle size, surfactant concentration, type of ultrasonic bath, and ultrasonic frequency.

In pure HFE-7100 in the CAE bath, complete particle removal was only observed for 5 μm particles. There was good removal of 3 μm particles, and poor removal of smaller particles. In the Crest baths, there was only slight removal of the 3 μm and 5 μm particles, and no removal of smaller particles.

In dilute Krytox 157 solutions (0.3 to 0.5 wt-%):

a. In the Crest 40 kHz bath, there was only good removal of particles 2 μm or larger and slight removal of smaller particles.
b. In the Crest 132 kHz bath there was nearly complete removal of particles 2 μm or larger, moderate removal of 1-μm particles, and slight removal of smaller particles.
c. In the CAE bath, at 104 kHz, there was quasi-complete removal of 1-μm particles, good removal of 0.5 μm diameter particles, and slight removal of 0.2 μm particles. Removal efficiency of particles of this size was lower at the other frequencies. Removal of particles larger than 1 μm was not examined in this solution.

Increasing the surfactant concentration from 0.3 wt-% to 3 wt-% in the CAE bath had a slight effect on the removal of 1 μm diameter particles (i.e. particle removal efficiency increased at 170 kHz), and a significant effect on the removal of sub-micron particles. At 104 kHz, there was near complete removal of 0.5 μm particles, and moderate removal of 0.2 μm particles. At 170 kHz, there was good removal of 0.5 μm particles and moderate removal of 0.2 μm.

The near complete removal of 0.5 μm PSL particles in 3% Krytox/HFE-7100 solution at 104 kHz in just six minutes of sonication in the CAE bath is a very significant result in terms of being able to remove spores, which are biological particles of the same size.

Sonication in Krytox 157FS/HFE-7100 solutions also resulted in the removal of spores of *Bacillus subtilis* ATCC 9372 from glass slides, but not to the decontamination levels required, nor in the time frame of 15 minutes specified in the RFP.

A possible biological cleaning cycle, which follows the chemical decontamination, is summarized below:

| | | | Cumulative Cycle Time | |
|---|---|---|---|---|
| Step No. | Step | Step Time | Bio Cycle | Total Cycle |
| 11. | Wash 1 Liquid Fill | 0.5 | 0.5 | 8.0 |
| 12. | Wash 1 Sonicate | 1.0 | 1.5 | 9.0 |
| 13. | Spray while draining | 0.5 | 2.0 | 9.5 |
| 14. | Wash 2 Liquid Fill | 0.5 | 2.5 | 10.0 |
| 15. | Wash 2 Sonicate | 1.5 | 4.0 | 11.5 |
| 16. | Spray while draining | 0.5 | 4.5 | 12.0 |
| 17. | Rinse 3 Liquid Fill | 0.5 | 5.0 | 12.5 |
| 18. | Rinse 3 Sonicate | 1.0 | 6.0 | 13.5 |
| 19. | Drain | 1.0 | 7.0 | 14.5 |
| 20. | Remove Parts | 0.5 | 7.5 | 15.0 |

The above process sequence is slightly different than the one proposed for the removal of CWA, in that the parts are exposed to two 1-minute immersions in Krytox 157FS/HFE-7100 solution, and a 1-minute immersion in HFE-7100, as compared to three immersions in HFE-7100 of 1 min, 2 min, and 4 min for CWA removal. For CWA removal, increasingly longer cycle times are proposed because the rate of removal becomes more difficult as the surface concentration of CWA decreases. For spores, the probability of removing any one spore is independent of the surface spore population. Two wash cycles are proposed to minimize drag out residues at the end of the washing cycle.

Near complete removal of 0.5 μm PSL particles in a 3% Krytox/HFE-7100 solution by sonication at 104 kHz in the CAE bath in two 3-minute cycles was observed.

The foregoing description of the illustrative embodiments reveals the general nature of the decontamination system and method. Others of skill in the art will appreciate that applying ordinary skill may readily modify, or adapt, the system and method disclosed without undue experimentation.

The descriptions of the illustrative embodiments are illustrative, not limiting. The method and system have been described in detail for illustration. Variations to the specific details can be made by those skilled in the art without departing from the spirit and scope of the invention.

Descriptions of a class or range useful includes a description of any subrange or subclass contained therein, as well as a separate description of each member, or value in said class.

What is claimed is:

1. A method for removing chemical warfare agents from an article comprising the steps of:

a). immersing said article in a decontamination liquid wherein said chemical warfare agents are at least partially soluble;

b). ultrasonically agitating said liquid while said article is immersed therein;

c). filtering said decontamination liquid through an activated carbon medium to remove said chemical warfare agent from said decontamination in liquid;

d). applying a fluorescent simulant to said article prior to immersion in said decontamination liquid and analyzing said decontamination liquid to determine when the simulant has been substantially removed from said decontamination liquid;

e). removing said article from said decontamination liquid;

f). wherein the decontamination liquid is selected from the group consisting of $C_5F_9H_3O$ and $C_6F_9H_5O$.

2. A method according to claim 1 further comprising the step of recirculating said decontamination liquid through said activated carbon medium while said article is immersed in said decontamination liquid.

* * * * *